US010633724B2

(12) United States Patent
Unal et al.

(10) Patent No.: US 10,633,724 B2
(45) Date of Patent: Apr. 28, 2020

(54) ALUMINUM ALLOY PRODUCTS AND METHODS FOR PRODUCING SAME

(71) Applicants: Ali Unal, Export, PA (US); Gavin F. Wyatt-Mair, LaFayette, CA (US); David A. Tomes, San Antonio, TX (US); Thomas N. Rouns, Pittsburgh, PA (US); Lynette M. Karabin, Ruffs Dale, PA (US)

(72) Inventors: Ali Unal, Export, PA (US); Gavin F. Wyatt-Mair, LaFayette, CA (US); David A. Tomes, San Antonio, TX (US); Thomas N. Rouns, Pittsburgh, PA (US); Lynette M. Karabin, Ruffs Dale, PA (US)

(73) Assignee: ARCONIC INC., Pittsburgh, PA (US)

( * ) Notice: Subject to any disclaimer, the term of this patent is extended or adjusted under 35 U.S.C. 154(b) by 0 days.

(21) Appl. No.: 14/480,370

(22) Filed: Sep. 8, 2014

(65) Prior Publication Data

US 2015/0071816 A1 Mar. 12, 2015

Related U.S. Application Data

(60) Provisional application No. 61/874,828, filed on Sep. 6, 2013.

(51) Int. Cl.
*C22C 1/00* (2006.01)
*C22C 21/00* (2006.01)
(Continued)

(52) U.S. Cl.
CPC ..... *C22C 21/00* (2013.01); *B22D 11/003* (2013.01); *B22D 11/0622* (2013.01);
(Continued)

(58) Field of Classification Search
CPC ..... C22C 21/00; C22C 21/08; C22C 21/003; C22C 21/006; C22C 21/02; C22C 21/06;
(Continued)

(56) References Cited

U.S. PATENT DOCUMENTS 3,989,548 A * 11/1976 Morris ..... C22C 1/026 148/437
4,969,428 A * 11/1990 Donahue et al. ..... 123/195 R
(Continued)

FOREIGN PATENT DOCUMENTS

CN 1450185 A 10/2003
CN 101230431 A 7/2008
(Continued)

OTHER PUBLICATIONS

International Search Report and Written Opinion from International Application PCT/US2014/054588 dated Jan. 2, 2015.

*Primary Examiner* — Matthew E. Hoban
(74) *Attorney, Agent, or Firm* — Greenberg Traurig, LLP

(57) ABSTRACT

An aluminum alloy product and method for producing the aluminum alloy product that, in some embodiments, includes an aluminum alloy strip having at least 0.8 wt. % manganese, at least 0.6 wt % iron, or at least 0.8 wt. % manganese and at least 0.6 wt % iron. A near surface of the aluminum alloy strip, in some embodiments, is substantially free of large particles having an equivalent diameter of at least 50 micrometers and includes small particles. Each small particle, in some embodiments, has a particular equivalent diameter that is less than 3 micrometers, and a quantity per unit area of the small particles having the particular equivalent diameter is at least 0.01 particles per square micrometer at the near surface of the aluminum alloy strip.

11 Claims, 18 Drawing Sheets

(51) Int. Cl.

| | |
|---|---|
| ***B22D 11/06*** | (2006.01) |
| ***B22D 11/00*** | (2006.01) |
| ***C22C 21/08*** | (2006.01) |
| *C22F 1/047* | (2006.01) |
| *C22F 1/04* | (2006.01) |

(52) U.S. Cl.
CPC ..... *C22C 21/08* (2013.01); *C22F 1/04* (2013.01); *C22F 1/047* (2013.01)

(58) Field of Classification Search
CPC ..... C22C 21/04; C22C 21/10; C22C 21/12; C22C 21/14; C22C 21/16; C22C 21/18
See application file for complete search history.

(56) References Cited

U.S. PATENT DOCUMENTS

| | | | | |
|---|---|---|---|---|
| 5,253,625 | A | 10/1993 | Donahue et al. | |
| 5,411,605 | A | 5/1995 | Omori et al. | |
| 5,686,194 | A * | 11/1997 | Shimizu | B32B 15/08 420/103 |
| 5,899,105 | A * | 5/1999 | Erhard | 72/370.08 |

FOREIGN PATENT DOCUMENTS

| | | | |
|---|---|---|---|
| CN | 101497966 | B * | 1/2011 |
| CN | 102264930 | A | 11/2011 |
| JP | 1996-302440 | A | 11/1996 |
| JP | 2010-255120 | A | 11/2010 |
| WO | 2013188668 | A2 | 12/2013 |

* cited by examiner

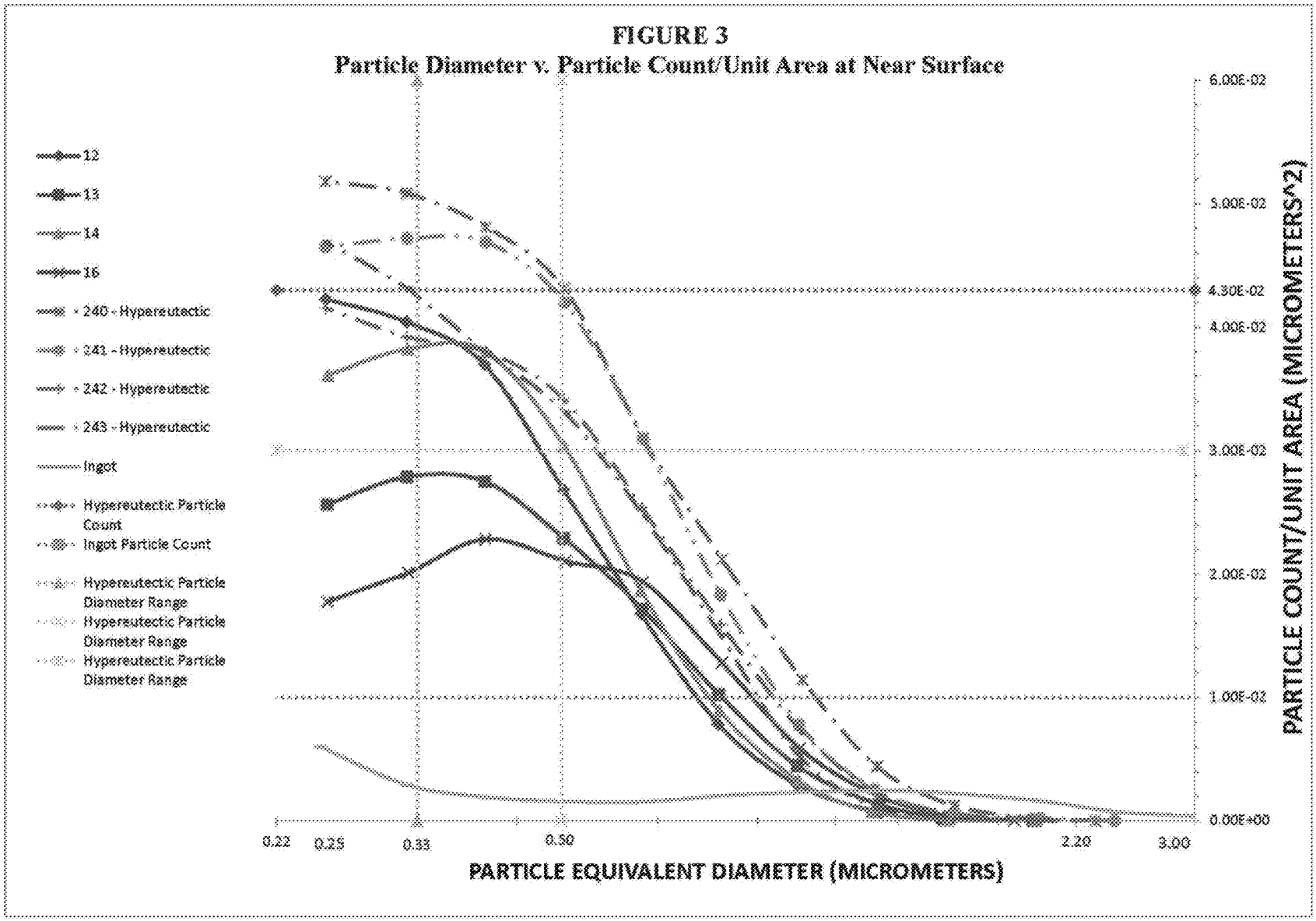
FIGURE 3
Particle Diameter v. Particle Count/Unit Area at Near Surface
PARTICLE COUNT/UNIT AREA (MICROMETERS^2)
6.00E-02
5.00E-02
4.30E-02
4.00E-02
3.00E-02
2.00E-02
1.00E-02
0.00E+00
0.22
0.25
0.33
0.50
2.20
3.00
PARTICLE EQUIVALENT DIAMETER (MICROMETERS)
12
13
14
16
240 - Hypereutectic
241 - Hypereutectic
242 - Hypereutectic
243 - Hypereutectic
Ingot
Hypereutectic Particle Count
Ingot Particle Count
Hypereutectic Particle Diameter Range
Hypereutectic Particle Diameter Range
Hypereutectic Particle Diameter Range Particle Diameter v. Volume Fraction at Near Surface Tensile Yield Strength - 100 h Exposures
Tensile Yield Strength, ksi
65
60
55
50
45
40
35
30
0
100
200
300
400
500
Exposure Temperature, F
240
241
242
243
265
266
267
268
269
270
271
2219-T87

Tensile Yield Strength - 500 h Exposures

Ultimate Tensile Strength - 500 h Exposures
Ultimate Tensile Strength, ksi
65
60
55
50
45
40
0
100
200
300
400
500
Exposure Temperature, F
242
241
240
243

Elevated Temperature Tensile Strength - 500 h Exposures

ALUMINUM ALLOY PRODUCTS AND METHODS FOR PRODUCING SAME

RELATED APPLICATIONS

This application claims the benefit of U.S. Provisional Application No. 61/874,828, entitled "ALUMINUM ALLOY PRODUCTS AND METHODS FOR PRODUCING SAME" filed Sep. 6, 2014, which is hereby incorporated by reference herein in its entirety for all purposes.

TECHNICAL FIELD

The products and methods detailed herein relate to aluminum alloys.

BACKGROUND OF THE INVENTION

Aluminum alloys and methods for producing aluminum alloys are known.

SUMMARY OF INVENTION

In some embodiments, the present invention is a product comprising an aluminum alloy strip that includes (i) at least 0.8 wt. % manganese; or (ii) at least 0.6 wt % iron; or (iii) at least 0.8 wt. % manganese and at least 0.6 wt % iron. In some embodiments, a near surface of the aluminum alloy strip is substantially free of large particles having an equivalent diameter of at least 50 micrometers. In yet other embodiments, the near surface of the aluminum alloy strip includes small particles, each small particle has a particular equivalent diameter, the particular equivalent diameter is less than 3 micrometers, and a quantity per unit area of the small particles having the particular equivalent diameter is at least 0.01 particles per square micrometer at the near surface of the aluminum alloy strip.

In some embodiments, the near surface of the aluminum alloy strip is substantially free of large particles having an equivalent diameter of at least 20 micrometers. In some embodiments, the near surface of the aluminum alloy strip is substantially free of large particles having an equivalent diameter of at least 3 micrometers.

In some embodiments, the at least 0.8 wt. % manganese, the at least 0.6 wt % iron, or the at least 0.8 wt. % manganese and the at least 0.6 wt % iron are contained within the aluminum alloy strip at such a level as to achieve a hypereutectic composition.

In some embodiments, an oxygen content of the aluminum alloy strip is 0.1 weight percent or less. In some embodiments, the oxygen content of the aluminum alloy strip is 0.01 weight percent or less. In some embodiments, the particular equivalent diameter is at least 0.3 micrometers. In some embodiments, the particular equivalent diameter ranges from 0.3 micrometers to 0.5 micrometers.

In some embodiments, the particular equivalent diameter is 0.5 micrometers and wherein the quantity per unit area of the small particles having the particular equivalent diameter is at least 0.03 particles per square micrometer at the near surface of the aluminum alloy strip. In other embodiments, the product is selected from the group consisting of can body stock and can end stock.

In some embodiments, the present invention includes an aluminum alloy strip that includes (i) at least 0.8 wt. % manganese; or (ii) at least 0.6 wt % iron; or (iii) at least 0.8 wt. % manganese and at least 0.6 wt % iron. In some embodiments, a near surface of the aluminum alloy strip includes small particles and each small particle has a particular equivalent diameter. In other embodiments, the particular equivalent diameter is less than 1 micrometer and a volume fraction of the small particles having the particular equivalent diameter is at least 0.2 percent at the near surface of the aluminum alloy strip.

In some embodiments, the volume fraction of the small particles having the particular equivalent diameter is at least 0.65 percent. In yet other embodiments, the particular equivalent diameter ranges from 0.5 micrometers to 0.85 micrometers. In some embodiments, the at least 0.8 wt. % manganese, the at least 0.6 wt % iron, or the at least 0.8 wt. % manganese and at least 0.6 wt % iron are contained within the aluminum alloy strip as such a level as to achieve a hypereutectic composition.

In some embodiments, an oxygen content of the aluminum alloy strip is 0.05 weight percent or less.

In some embodiments, the method includes selecting a hypereutectic aluminum alloy having (i) at least 0.8 wt. % manganese; or (ii) at least 0.6 wt % iron; or (iii) at least 0.8 wt. % manganese and at least 0.6 wt % iron. In embodiments, the method further includes casting the hypereutectic aluminum alloy at a sufficient speed so as to result in a cast product having a near surface that is substantially free of large particles having an equivalent diameter of at least 50 micrometers.

In other embodiments, the casting step includes casting the hypereutectic aluminum alloy at a sufficient speed so as to result in a cast product having a near surface that is substantially free of large particles having an equivalent diameter of at least 20 micrometers. In some embodiments, the casting step includes casting the hypereutectic aluminum alloy at a sufficient speed so as to result in a cast product having a near surface that is substantially free of large particles having an equivalent diameter of at least 3 micrometers.

In yet other embodiments, the casting step includes delivering the hypereutectic aluminum alloy to a pair of rolls at a speed. In some embodiments, the rolls are configured to form a nip and the speed ranges from 50 to 300 feet per minute.

In some embodiments, the method further includes solidifying the hypereutectic aluminum alloy to produce solid outer portions adjacent to each roll and a semi-solid central portion between the solid outer portions; and solidifying the central portion within the nip to form a cast product.

In some embodiments, the method further includes hot rolling, cold rolling, and/or annealing the cast product sufficiently to form an aluminum alloy strip. In some embodiments, the aluminum alloy strip includes a near surface of the aluminum alloy strip includes small particles, each small particle has a particular equivalent diameter, the particular equivalent diameter is less than 3 micrometers, and a quantity per unit area of the small particles having the particular equivalent diameter is at least 0.01 particles per square micrometer at the near surface of the aluminum alloy strip.

BRIEF DESCRIPTION OF THE DRAWINGS

The present invention will be further explained with reference to the attached drawings, wherein like structures are referred to by like numerals throughout the several views. The drawings shown are not necessarily to scale, with emphasis instead generally being placed upon illustrating the principles of the present invention. Further, some features may be exaggerated to show details of particular components.

FIG. 3 illustrates the particle count per unit area profiles of some embodiments of the present invention.

Figure 1:
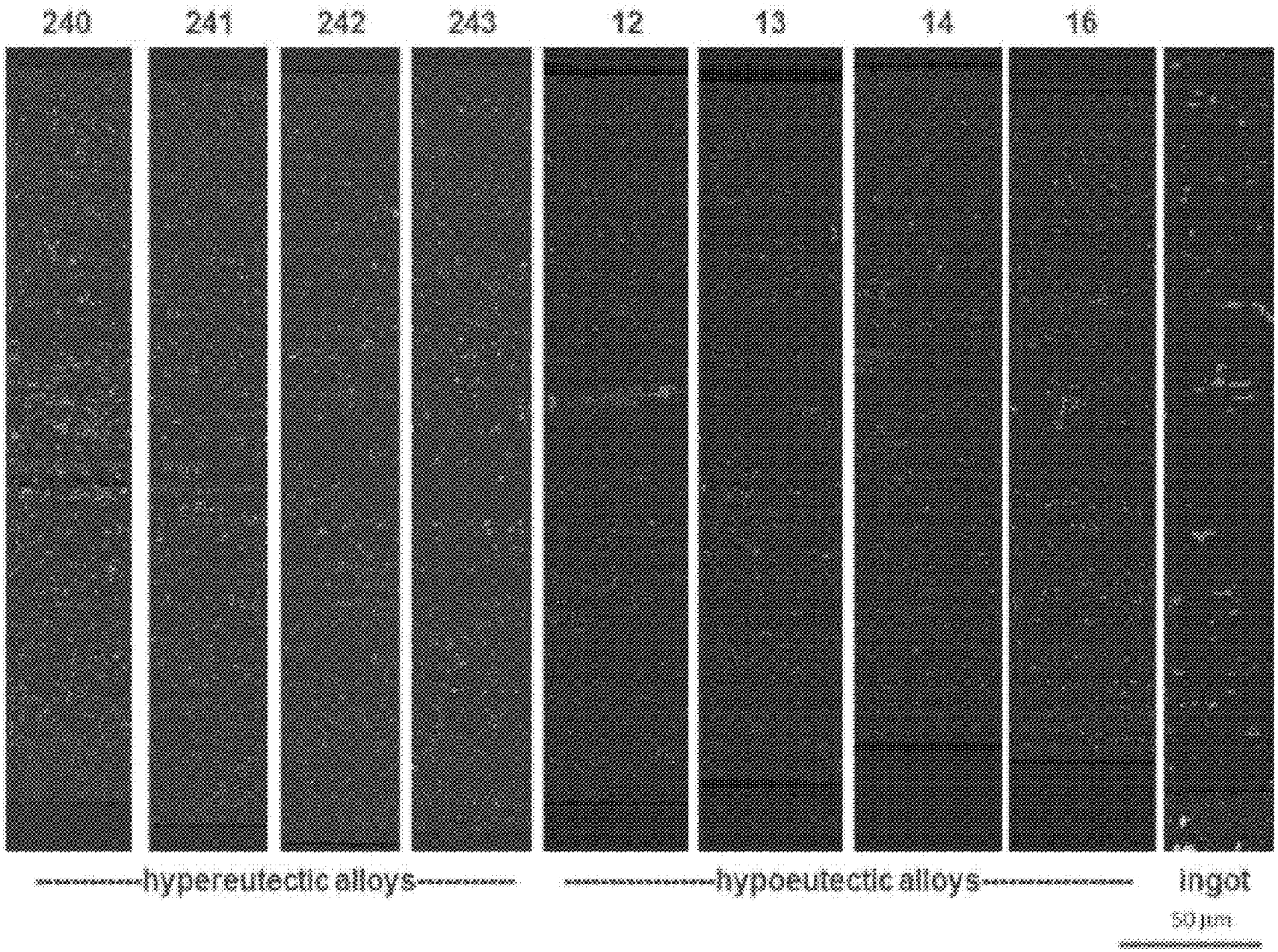
FIG. 1 is a photomicrograph showing features of some embodiments of the present invention.

The figures constitute a part of this specification and include illustrative embodiments of the present invention and illustrate various objects and features thereof. Further, the figures are not necessarily to scale, some to features may be exaggerated show details of particular components. In addition, any measurements, specifications and the like shown in the figures are intended to be illustrative, and not restrictive. Therefore, specific structural and functional details disclosed herein are not to be interpreted as limiting, but merely as a representative basis for teaching one skilled in the art to variously employ the present invention.

DETAILED DESCRIPTION

The present invention will be further explained with reference to the attached drawings, wherein like structures are referred to by like numerals throughout the several views. The drawings shown are not necessarily to scale, with emphasis instead generally being placed upon illustrating the principles of the present invention. Further, some features may be exaggerated to show details of particular components.

The figures constitute a part of this specification and include illustrative embodiments of the present invention and illustrate various objects and features thereof. Further, the figures are not necessarily to scale, some features may be exaggerated to show details of particular components. In addition, any measurements, specifications and the like shown in the figures are intended to be illustrative, and not restrictive. Therefore, specific structural and functional details disclosed herein are not to be interpreted as limiting, but merely as a representative basis for teaching one skilled in the art to variously employ the present invention.

Among those benefits and improvements that have been disclosed, other objects and advantages of this invention will become apparent from the following description taken in conjunction with the accompanying figures. Detailed embodiments of the present invention are disclosed herein; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrases "in one embodiment" and "in some embodiments" as used herein do not necessarily refer to the same embodiment(s), though it may. Furthermore, the phrases "in another embodiment" and "in some other embodiments" as used herein do not necessarily refer to a different embodiment, although it may. Thus, as described below, various embodiments of the invention may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

In an embodiment, the product comprises an aluminum alloy strip; wherein the aluminum alloy strip includes: (i) at least 0.8 wt. % manganese; or (ii) at least 0.6 wt % iron; or (iii) at least 0.8 wt. % manganese and at least 0.6 wt % iron; wherein a near surface of the aluminum alloy strip is substantially free of large particles having an equivalent diameter of at least 50 micrometers; wherein the near surface of the aluminum alloy strip includes small particles; wherein each small particle has a particular equivalent diameter, wherein the particular equivalent diameter is less than 3 micrometers; and wherein a quantity per unit area of the small particles having the particular equivalent diameter is at least 0.01 particles per square micrometer at the near surface of the aluminum alloy strip.

In another embodiment, the near surface of the aluminum alloy strip is substantially free of large particles having an equivalent diameter of at least 30 micrometers. In one embodiment, the near surface of the aluminum alloy strip is substantially free of large particles having an equivalent diameter of at least 20 micrometers. In an embodiment, the near surface of the aluminum alloy strip is substantially free of large particles having an equivalent diameter of at least 10 micrometers. In another embodiment, the near surface of the aluminum alloy strip is substantially free of large particles having an equivalent diameter of at least 3 micrometers.

In some embodiments, the at least 0.8 wt. % manganese, the at least 0.6 wt % iron, or the at least 0.8 wt. % manganese and the at least 0.6 wt % iron are contained within the aluminum alloy strip at such a level as to achieve a hypereutectic composition.

In an embodiment, the oxygen content of the aluminum alloy strip is 0.1 weight percent or less. In another embodiment, the oxygen content of the aluminum alloy strip is 0.05 weight percent or less. In yet another embodiment, the oxygen content of the aluminum alloy strip is 0.01 weight percent or less. In an embodiment, an oxygen content of the aluminum alloy strip is 0.005 weight percent or less.

In some embodiments, the particular equivalent diameter is at least 0.3 micrometers. In other embodiments, the particular equivalent diameter ranges from 0.3 micrometers to 0.5 micrometers.

In an embodiment, the particular equivalent diameter is 0.5 micrometers and wherein the quantity per unit area of the small particles having the particular equivalent diameter is at least 0.03 particles per square micrometer at the near surface of the aluminum alloy strip.

In another embodiment, the quantity per unit area of the small particles having the particular equivalent diameter is at least 0.02 particles per square micrometer. In yet another embodiment, the quantity per unit area of the small particles having the particular equivalent diameter is at least 0.04 particles per square micrometer. In some embodiments, the quantity per unit area of the small particles having the particular equivalent diameter ranges from 0.043 to 0.055 particles per square micrometer.

In some embodiments, the product is can body stock. In other embodiments, the product is can end stock. In still other embodiments, the product is adapted for use in elevated temperature applications.

In some embodiments, the aluminum strip includes at least 1.6 wt. % manganese and iron. In some embodiments, the aluminum strip includes at least 1.8 wt. % manganese and iron. In some embodiments, the aluminum strip includes at least 2.0 wt. % manganese and iron. In some embodiments, the aluminum strip includes at least 2.5 wt. % manganese and iron. In still other embodiments, the aluminum strip includes at least 3.0 wt. % manganese and iron.

In an embodiment, the product comprises an aluminum alloy strip; wherein the aluminum alloy strip includes: (i) at least 0.8 wt. % manganese; or (ii) at least 0.6 wt % iron; or (iii) at least 0.8 wt. % manganese and at least 0.6 wt % iron; wherein a near surface of the aluminum alloy strip includes small particles; wherein each small particle has a particular equivalent diameter, wherein the particular equivalent diameter is less than 1 micrometer; And wherein a volume fraction of the small particles having the particular equivalent diameter is at least 0.2 percent at the near surface of the aluminum alloy strip.

In an embodiment, the volume fraction of the small particles having the particular equivalent diameter is at least 0.65 percent. In another embodiment, the particular equivalent diameter is less than 0.85 micrometers. In yet another embodiment, the particular equivalent diameter ranges from 0.5 micrometers to 0.85 micrometers.

In a further embodiment, the at least 0.8 wt. % manganese, the at least 0.6 wt % iron, or the at least 0.8 wt. % manganese and at least 0.6 wt % iron are contained within the aluminum alloy strip as such a level as to achieve a hypereutectic composition.

In yet another embodiment, the product comprises an aluminum alloy strip; wherein the aluminum alloy strip includes: (i) at least 0.8 wt. % manganese; or (ii) at least 0.6 wt % iron; or (iii) at least 0.8 wt. % manganese and at least 0.6 wt % iron; wherein each small particle has a particular equivalent diameter; wherein the particular equivalent diameter is less than 1 micrometer; wherein a volume fraction of the small particles having the particular equivalent diameter is at least 0.2 percent at the near surface of the aluminum alloy strip; wherein, when the aluminum alloy strip and a reference material are exposed to a temperature of at least 75° Fahrenheit ("° F.") for 100 hours, a first tensile yield strength of the aluminum alloy strip is greater than a second tensile yield strength of the reference material; and wherein the reference material is aluminum alloy 2219 having a T87 temper.

In another embodiment, the aluminum alloy strip and the reference material are exposed to a temperature of at least 75° F. for 100 hours, the first tensile yield strength of the aluminum alloy strip is at least 5% greater than the second tensile yield strength of the reference material. In some embodiments, when the aluminum alloy strip and the reference material are exposed to a temperature of at least 75° F. for 100 hours, the first tensile yield strength of the aluminum alloy strip is at least 10% greater than the second tensile yield strength of the reference material. In other embodiments, when the aluminum alloy strip and the reference material are exposed to a temperature of at least 75° F. for 100 hours, the first tensile yield strength of the aluminum alloy strip is at least 15% greater than the second tensile yield strength of the reference material. In yet other embodiments, when the aluminum alloy strip and the reference material are exposed to a temperature of at least 75° F. for 100 hours, the first tensile yield strength of the aluminum alloy strip is at least 20% greater than the second tensile yield strength of the reference material. It is expected that exposing the aluminum alloy strip of some embodiments of the present invention and the aluminum alloy 2219 having a T87 temper reference material at 75° F. for 500 hours will yield similar relative results as those detailed above for exposure at 75° F. for 100 hours. For example, in an embodiment, the aluminum alloy strip and the reference material are exposed to a temperature of at least 75° F. for 500 hours, the first tensile yield strength of the aluminum alloy strip is at least 5% greater than the second tensile yield strength of the reference material.

In some embodiments, the product comprises an aluminum alloy strip; wherein the aluminum alloy strip includes: (i) at least 0.8 wt. % manganese; or (ii) at least 0.6 wt % iron; or (iii) at least 0.8 wt. % manganese and at least 0.6 wt % iron; wherein each small particle has a particular equivalent diameter; wherein the particular equivalent diameter is less than 1 micrometer; wherein a volume fraction of the small particles having the particular equivalent diameter is at least 0.2 percent at the near surface of the aluminum alloy strip; and wherein, when the aluminum alloy strip is exposed to a temperature of at least 75° F. for 500 hours, a tensile yield strength of the aluminum alloy strip is at least 35 ksi as measured by ASTM E8.

In other embodiments, the tensile yield strength of the aluminum alloy strip is at least 40 ksi as measured by ASTM E8. In yet other embodiments, the tensile yield strength of the aluminum alloy strip is at least 45 ksi as measured by ASTM E8. In other embodiments, the tensile yield strength of the aluminum alloy strip is at least 50 ksi as measured by ASTM E8.

In some embodiments, the product comprises an aluminum alloy strip; wherein the aluminum alloy strip includes: (i) at least 0.8 wt. % manganese; or (ii) at least 0.6 wt % iron; or (iii) at least 0.8 wt. % manganese and at least 0.6 wt % iron; wherein each small particle has a particular equivalent diameter, wherein the particular equivalent diameter is less than 1 micrometer; wherein a volume fraction of the small particles having the particular equivalent diameter is at least 0.2 percent at the near surface of the aluminum alloy strip; and wherein, when the aluminum alloy strip is exposed to a particular temperature of greater than 75° F. for 500 hours, an elevated temperature tensile yield strength of the aluminum alloy strip is at least 15 ksi as measured by ASTM E21 at the particular temperature.

In an embodiment, the elevated temperature tensile yield strength of the aluminum alloy strip is at least 20 ksi as measured by ASTM E21 at the particular temperature. In another embodiment, the tensile yield strength of the aluminum alloy strip is at least 25 ksi as measured by ASTM E21 at the particular temperature. In yet another embodiment, the tensile yield strength of the aluminum alloy strip is at least 30 ksi as measured by ASTM E21 at the particular temperature.

In some embodiments, the product includes an aluminum alloy strip consisting of:

from 0.8 to 8.0 wt. % Mn;
from 0.6 to 5.0 wt. % Fe;
from 0.15 to 1.0 wt. % Si;
from 0.15 to 1.0 wt. % Cu;
from 0.8 to 3.0 wt. % Mg;
up to 0.5 wt. % Zn; and
up to 0.05 wt. % oxygen;
a balance being aluminum, and other elements,
wherein the aluminum alloy strip includes not greater than 0.25 wt. % of any one of the other elements, wherein the aluminum alloy strip includes not greater than 0.50 wt. % total of the other elements; wherein a near surface of the aluminum alloy strip is substantially free of large particles having an equivalent diameter of at least 50 micrometers; wherein the near surface of the aluminum alloy strip includes small particles; wherein each small particle has a particular equivalent diameter, wherein the particular equivalent diameter is less than 3 micrometers; and wherein a quantity per unit area of the small particles having the particular equivalent diameter is at least 0.01 particles per square micrometer at the near surface of the aluminum alloy strip.

In some embodiments, the method comprises selecting a hypereutectic aluminum alloy having: (i) at least 0.8 wt. % manganese; or (ii) at least 0.6 wt % iron; or (iii) at least 0.8 wt. % manganese and at least 0.6 wt % iron; casting the hypereutectic aluminum alloy at a sufficient speed so as to result in a cast product having a near surface that is substantially free of large particles having an equivalent diameter of at least 50 micrometers.

In some embodiments, the casting step comprises: casting the hypereutectic aluminum alloy at a sufficient speed so as to result in a cast product having a near surface that is substantially free of large particles having an equivalent diameter of at least 40 micrometers.

In some embodiments, the casting step comprises: casting the hypereutectic aluminum alloy at a sufficient speed so as to result in a cast product having a near surface that is substantially free of large particles having an equivalent diameter of at least 30 micrometers.

In other embodiments, the casting step comprises: casting the hypereutectic aluminum alloy at a sufficient speed so as to result in a cast product having a near surface that is substantially free of large particles having an equivalent diameter of at least 20 micrometers.

In yet other embodiments, the casting step comprises: casting the hypereutectic aluminum alloy at a sufficient speed so as to result in a cast product having a near surface that is substantially free of large particles having an equivalent diameter of at least 10 micrometers.

In some embodiments, the casting step comprises: casting the hypereutectic aluminum alloy at a sufficient speed so as to result in a cast product having a near surface that is substantially free of large particles having an equivalent diameter of at least 3 micrometers.

In some embodiments, the casting step comprises: delivering the hypereutectic aluminum alloy to a pair of rolls at a speed; wherein the rolls are configured to form a nip; wherein the speed ranges from 50 to 300 feet per minute; solidifying the hypereutectic aluminum alloy to produce solid outer portions adjacent to each roll and a semi-solid central portion between the solid outer portions; and solidifying the central portion within the nip to form a cast product.

In yet other embodiments, the method comprises: hot rolling, cold rolling, and/or annealing the cast product sufficiently to form an aluminum alloy strip; wherein a near surface of the aluminum alloy strip includes small particles; wherein each small particle has a particular equivalent diameter; wherein the particular equivalent diameter is less than 3 micrometers; and wherein a quantity per unit area of the small particles having the particular equivalent diameter is at least 0.01 particles per square micrometer at the near surface of the aluminum alloy strip. In an embodiment, the method comprises (i) hot rolling the cast product to form a first rolled product; and (ii) cold rolling the first rolled product to form a second rolled product. In the embodiment, the method comprises: (iii) annealing the second rolled product to form an annealed product. In another embodiment, the second rolled product is annealed at 850° F. for 3 hours. In yet another embodiment, the second rolled product is batch annealed at 850° F. for 3 hours. In another embodiment, the second rolled product is batch annealed at 875° F. for 4 hours.

In yet another embodiment, the method comprises: (iv) cold rolling the annealed product to form an aluminum alloy strip; wherein a near surface of the aluminum alloy strip includes small particles; wherein each small particle has a particular equivalent diameter, wherein the particular equivalent diameter is less than 3 micrometers; and wherein a quantity per unit area of the small particles having the particular equivalent diameter is at least 0.01 particles per square micrometer at the near surface of the aluminum alloy strip.

As used herein, "near surface" means from the surface of the final product—the product after casting, hot or cold rolling, and/or batch annealing—to a depth of about 37 micrometers below the surface of the final product. In some embodiments, the near surface is between T and T/7.

As used herein, "large particles" means particles having an equivalent diameter of 3 micrometers or more.

As used herein, "small particles" means particles having an equivalent diameter of greater than 0.22 micrometers and less than 3 micrometers. In some embodiments, small particles do not include dispersoids. In some embodiments, small particles include dispersoids.

Figure 4:
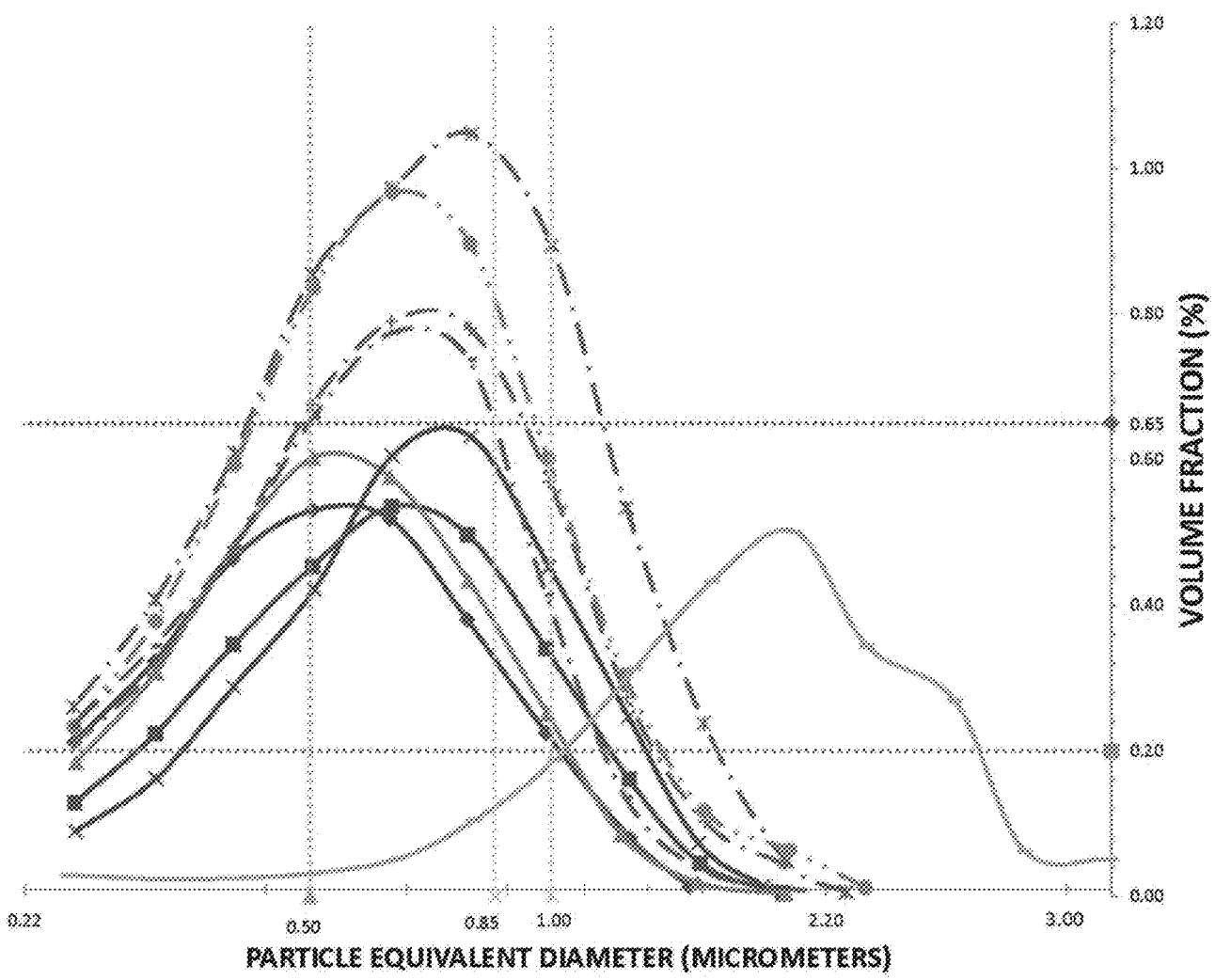
FIG. 4 illustrates the volume fraction profiles of some embodiments of the present invention.

As used herein, "substantially free of large particles" means substantially free of particles such that at least 90% of the total quantity of particles have an equivalent diameter less than 3 microns. In some embodiments, "substantially free of large particles" means substantially free of particles such that at least 91% of the total quantity of particles have an equivalent diameter less than 3 microns. In some embodiments, "substantially free of large particles" means substantially free of particles such that at least 93% of the total quantity of particles have an equivalent diameter less than 3 microns. In some embodiments, "substantially free of large particles" means substantially free of particles such that at least 95% of the total quantity of particles have an equivalent diameter less than 3 microns. In some embodiments, "substantially free of large particles" means substantially free of particles such that at least 97% of the total quantity of particles have an equivalent diameter less than 3 microns. In some embodiments, "substantially free of large particles" means substantially free of particles such that at least 98% of the total quantity of particles have an equivalent diameter less than 3 microns. In some embodiments, "substantially free of large particles" means substantially free of particles such that at least 99% of the total quantity of particles have an equivalent diameter less than 3 microns. In some embodiments, a product that is substantially free of large particles has a particle count per unit area v. particle equivalent diameter and volume fraction v. particle equivalent diameter as shown in FIGS. 3 and 4, respectively.

As used herein, "cupping" means a drawing process used to convert a strip into a can without substantially reducing the wall thickness. Cupping is commonly referred to as "drawing".

As used herein, "ironing" means a process of thinning a side wall of a cylindrical metal container such as a can to increase the height of the side wall. In some embodiments, ironing uses one or more circular ironing dies positioned on the exterior surface of the cylindrical metal container.

In some embodiments, the ironing die requires cleaning when sufficient buildup of oxides, metal, or other particulates on the inner surface of the die results in scoring of a can during ironing.

As used herein, "particle count" means the quantity of particles shown on a photomicrograph obtained using the Photomicrograph Procedure detailed herein and determined pursuant to the Photomicrograph Analysis Procedure detailed herein. In an embodiment, particle count only includes particles having an equivalent diameter greater than 0.22 micrometers.

As used herein, "volume fraction" means a percentage of volume occupied by a particle or a plurality of particles.

As used herein, "particle area" means the area of a particle as determined by the Photomicrograph Analysis Procedure described herein.

As used herein, "particle equivalent diameter" means $2\times\sqrt{(\text{particle area/pi})}$ or the product of 2 and the square root of (particle area divided by pi).

As used herein, "particular diameter" means a single diameter.

As used herein, "hypereutectic alloy" means an alloy containing greater than the eutectic amounts of solutes. For purposes of the present patent application, an alloy is hypereutectic when it achieves a particle size distribution in a near surface as described herein and generally having a particle count per unit area in a near surface of particles having an particular equivalent diameter of less than 3 micrometers of at least 0.043 particles/square micrometer and/or a volume fraction in a near surface of particles having a particular equivalent diameter of less than 3 micrometers of at least 0.65%.

As used herein, "strip" may be of any suitable thickness, and is generally of sheet gauge (0.006 inch to 0.249 inch) or thin-plate gauge (0.250 inch to 0.400 inch), i.e., has a thickness in the range of from 0.006 inch to 0.400 inch. In one embodiment, the strip has a thickness of at least 0.040 inch. In one embodiment, the strip has a thickness of at not greater than 0.320 inch. In one embodiment, the strip has a thickness of from 0.0070 to 0.018, such as when used for canning applications.

As used herein, "exposing" means raising, lowering or maintaining a temperature of a sample to match a target temperature. For example, exposing an aluminum alloy strip to a temperature of 75° F. means maintaining the temperature of the aluminum alloy strip at 75° F. In another example, exposing a reference material to a temperature of 350° F. means raising the temperature of the reference material to 350° F. In another example, exposing an aluminum alloy strip to a temperature of 350° F. for 100 hours means raising the temperature of the sample to a temperature of 350° F. and maintaining the temperature for 100 hours. In yet another example, exposing an aluminum alloy strip to a temperature of 400° F. for 500 hours means raising the temperature of the sample to a temperature of 400° F. and maintaining the temperature for 500 hours.

As used herein, "elongation", "tensile yield strength" and "ultimate tensile strength" are determined at room temperature pursuant to ASTM E8 [2013]("ASTM E8").

As used herein, "elevated temperature elongation", "elevated temperature tensile yield strength" and "elevated temperature ultimate tensile strength" are determined at a particular temperature above room temperature pursuant to ASTM E21 [2009]("ASTM E21").

As used herein, "oxygen content" means the weight percent (wt. %) of oxygen as determined by a LECO Oxygen-Nitrogen Analyzer. The technique incorporates gas fusion in a graphite crucible under a flowing inert gas stream of helium and includes the measurement of combustion gases by infrared absorption and thermal conductivity. Following the gas fusion, the process oxygen combines with carbon to form $CO_2$.

As used herein, "elevated temperature applications" means any application conducted at a temperature above room temperature. In an embodiment, the elevated temperature application is conducted at a temperature of at least 75° F. In an embodiment, the elevated temperature application is conducted at a temperature of at least 150° F. In an embodiment, the elevated temperature application is conducted at a temperature of at least 350° F. In an embodiment, the elevated temperature application is conducted at a temperature of at least 400° F. In an embodiment, the elevated temperature application is conducted at a temperature of at least 450° F.

In some embodiments, the elevated temperature application is conducted at a temperature of 100° F. to 1000° F. In an embodiment, the elevated temperature application is conducted at a temperature of 150° F. to 1000° F. In an embodiment, the elevated temperature application is conducted at a temperature of 200° F. to 900° F. In an embodiment, the elevated temperature application is conducted at a temperature of 300° F. to 800° F. In an embodiment, the elevated temperature application is conducted at a temperature of 100° F. to 450° F. In an embodiment, the elevated temperature application is conducted at a temperature of 150° F. to 350° F.

As used herein, a "can" is any metal container, such as a can, bottle, aerosol can, food can, drinking cup or related product.

As used herein, "can making applications" means any application related to the production of cans or related products. In some embodiments, can making applications include the use of aluminum alloy strips as can sheet stock for producing can bodies and/or can ends.

In an embodiment, the present patent application generally relates to aluminum alloy strips for use in can making applications and elevated temperature applications. In an embodiment, the present patent application also relates to methods of producing aluminum alloy strips for use in can making applications and elevated temperature applications. In some embodiments of the invention, aluminum alloys in non-sheet based forms, such as slugs, are used in can making applications, such as forming a can via impact extrusion.

Aluminum Alloy Strip

A. Composition

In some embodiments, the aluminum alloy strip may include any aluminum alloy having at least 0.8 wt. % manganese (Mn), at least 0.6 wt. % iron (Fe), or at least 0.8 wt. % Mn and at least 0.6 wt. % Fe. In some embodiments, the aluminum alloy may include 3xxx (manganese based), 5xxx (magnesium based), 6xxx (magnesium and silicon based), or 8xxx aluminum alloys.

In one embodiment, the aluminum alloy strip has at least 0.8 wt. % Mn. In one embodiment, the aluminum alloy strip has at least 0.9 wt. % Mn. In one embodiment, the aluminum alloy strip has at least 1.0 wt. % Mn. In one embodiment, the aluminum alloy strip has at least 1.1 wt. % Mn. In one embodiment, the aluminum alloy strip has at least 1.2 wt. % Mn. In one embodiment, the aluminum alloy strip has at least 1.3 wt. % Mn. In one embodiment, the aluminum alloy strip has at least 1.4 wt. % Mn. In one embodiment, the aluminum alloy strip has at least 1.5 wt. % Mn. In one embodiment, the aluminum alloy strip has at least 1.6 wt. % Mn. In one embodiment, the aluminum alloy strip has at least 1.7 wt. % Mn. In one embodiment, the aluminum alloy strip has at least 1.8 wt. % Mn. In one embodiment, the aluminum alloy strip has at least 1.9 wt. % Mn. In one embodiment, the aluminum alloy strip has at least 2.0 wt. % Mn. In another embodiment, the aluminum alloy strip has at least 2.1 wt. % Mn. In yet another embodiment, the aluminum alloy strip has at least 1.5 wt. % Mn. In one embodiment, the aluminum alloy strip has at least 2.2 wt. % Mn. In another embodiment, the aluminum alloy strip has at least 2.5 wt. % Mn. In another embodiment, the aluminum alloy strip has at least 3.0 wt. % Mn. In yet another embodiment, the aluminum alloy strip has at least 3.5 wt. % Mn. In another embodiment, the aluminum alloy strip has at least 4.0 wt. % Mn. In one embodiment, the aluminum alloy strip has at least 4.5 wt. % Mn. In yet another embodiment, the aluminum alloy strip has at least 5.0 wt. % Mn. In another embodiment, the aluminum alloy strip has at least 5.5 wt. % Mn. In another embodiment, the aluminum alloy strip has at least 6.0 wt. % Mn. In another embodiment, the aluminum alloy strip has at least 6.5 wt. % Mn. In another embodiment, the aluminum alloy strip has at least 7.0 wt. % Mn. In another embodiment, the aluminum alloy strip has at least 7.5 wt. % Mn. In another embodiment, the aluminum alloy strip has at least 8.0 wt. % Mn.

In another embodiment, the Mn in the aluminum alloy strip ranges from 0.8 wt. % to 8.0 wt. %. In one embodiment, the Mn in the aluminum alloy strip ranges from 0.8 wt. % to 6.0 wt. %. In another embodiment, the Mn in the aluminum alloy strip ranges from 0.8 wt. % to 4.0 wt. %. In yet another embodiment, the Mn in the aluminum alloy strip ranges from 0.8 wt. % to 3.5 wt. %. In an embodiment, the Mn in the aluminum alloy strip ranges from 0.8 wt. % to 2.5 wt. %. In another embodiment, the Mn in the aluminum alloy strip ranges from 0.8 wt. % to 2.2 wt. %. Other of the above noted manganese minimums (e.g., at least 0.9 wt. % Mn, at least 1.0 wt. % Mn, at least 1.1 wt. % Mn, etc.) can be used with the maximums described in this paragraph. In some embodiments, the aluminum alloy strip has 0 wt. % Mn.

In one embodiment, the aluminum alloy strip has at least 0.6 wt. % Fe. In one embodiment, the aluminum alloy strip has at least 0.7 wt. % Fe. In one embodiment, the aluminum alloy strip has at least 0.8 wt. % Fe. In one embodiment, the aluminum alloy strip has at least 0.9 wt. % Fe. In one embodiment, the aluminum alloy strip has at least 1.0 wt. % Fe. In one embodiment, the aluminum alloy strip has at least 1.1 wt. % Fe. In one embodiment, the aluminum alloy strip has at least 1.2 wt. % Fe. In one embodiment, the aluminum alloy strip has at least 1.3 wt. % Fe. In one embodiment, the aluminum alloy strip has at least 1.4 wt. % Fe. In one embodiment, the aluminum alloy strip has at least 1.5 wt. % Fe. In one embodiment, the aluminum alloy strip has at least 1.6 wt. % Fe. In one embodiment, the aluminum alloy strip has at least 1.7 wt. % Fe. In one embodiment, the aluminum alloy strip has at least 1.8 wt. % Fe. In another embodiment, the aluminum alloy strip has at least 1.9 wt. % Fe. In yet another embodiment, the aluminum alloy strip has at least 2.0 wt. % Fe. In yet another embodiment, the aluminum alloy strip has at least 2.5 wt. % Fe. In another embodiment, the aluminum alloy strip has at least 3.0 wt. % Fe. In yet another embodiment, the aluminum alloy strip has at least 3.5 wt. % Fe. In another embodiment, the aluminum alloy strip has at least 4.0 wt. % Fe. In one embodiment, the aluminum alloy strip has at least 4.5 wt. % Fe. In yet another embodiment, the aluminum alloy strip has at least 5.0 wt. % Fe. In some embodiments, the aluminum alloy strip has 0 wt. % Fe. In some embodiments, the aluminum alloy strip has 0 wt. % Mn and 0 wt. % Fe.

In another embodiment, the Fe in the aluminum alloy strip ranges from 0.6 wt. % to 5.0 wt. %. In yet another embodiment, the Fe in the aluminum alloy strip ranges from 0.6 wt. % to 3.5 wt. %. In an embodiment, the Fe in the aluminum alloy strip ranges from 0.6 wt. % to 2.5 wt. %. In another embodiment, the Fe in the aluminum alloy strip ranges from 0.6 wt. % to 2.0 wt. %. Other of the above noted Fe minimums (e.g., at least 0.7 wt. % Fe, at least 0.8 wt. % Fe, at least 0.9 wt. % Fe, etc.) can be used with the maximums described in this paragraph.

As used herein, the "wt. % of Fe and Mn" means the sum of the wt. % of Fe and the wt. % of Mn. In one embodiment, the aluminum alloy strip has at least 1.4 wt. % of Fe and Mn. In one embodiment, the aluminum alloy strip has at least 1.5 wt. % of Fe and Mn. In one embodiment, the aluminum alloy strip has at least 1.6 wt. % of Fe and Mn. In one embodiment, the aluminum alloy strip has at least 1.7 wt. % of Fe and Mn. In another embodiment, the aluminum alloy strip has at least 1.8 wt. % of Fe and Mn. In one embodiment, the aluminum alloy strip has at least 1.9 wt. % of Fe and Mn. In yet another embodiment, the aluminum alloy strip has at least 2.0 wt. % of Fe and Mn. In one embodiment, the aluminum alloy strip has at least 2.1 wt. % of Fe and Mn. In one embodiment, the aluminum alloy strip has at least 2.2 wt. % of Fe and Mn. In one embodiment, the aluminum alloy strip has at least 2.3 wt. % of Fe and Mn. In one embodiment, the aluminum alloy strip has at least 2.4 wt. % of Fe and Mn. In one embodiment, the aluminum alloy strip has at least 2.5 wt. % of Fe and Mn. In another embodiment, the aluminum alloy strip has at least 3.0 wt. % of Fe and Mn. In yet another embodiment, the aluminum alloy strip has at least 3.5 wt. % of Fe and Mn. In another embodiment, the aluminum alloy strip has at least 4.0 wt. % of Fe and Mn. In one embodiment, the aluminum alloy strip has at least 5.0 wt. % of Fe and Mn. In yet another embodiment, the aluminum alloy strip has at least 6.0 wt. % of Fe and Mn. In another embodiment, the aluminum alloy strip has at least 7.0 wt. % of Fe and Mn. In yet another embodiment, the aluminum alloy strip has at least 8.0 wt. % of Fe and Mn. In one embodiment, the aluminum alloy strip has at least 10.0 wt. % of Fe and Mn.

In another embodiment, the wt. % of Fe and Mn in the aluminum alloy strip ranges from 1.4 wt. % to 10.0 wt. %. In yet another embodiment, the wt. % of Fe and Mn in the aluminum alloy strip ranges from 1.4 wt. % to 8.0 wt. %. In an embodiment, the wt. % of Fe and Mn in the aluminum alloy strip ranges from 1.4 wt. % to 7.0 wt. %. In another embodiment, the wt. % of Fe and Mn in the aluminum alloy strip ranges from 1.4 wt. % to 6.0 wt. %. In another embodiment, the wt. % of Fe and Mn in the aluminum alloy strip ranges from 1.4 wt. % to 5.0 wt. %. In another embodiment, the wt. % of Fe and Mn in the aluminum alloy strip ranges from 1.4 wt. % to 4.0 wt. %. Other of the above noted manganese+iron minimums (e.g., at least 1.5 wt. % Mn+Fe, at least 1.6 wt. % Mn+Fe, at least 1.7 wt. % Mn+Fe, etc.) can be used with the maximums described in this paragraph.

In some embodiments, the aluminum alloy strip includes a sufficient quantity of Mn and/or Fe to achieve a hypereutectic composition. In some embodiments, at least 0.8 wt. % Mn, at least 0.6 wt. % Fe, or at least 0.8 wt. % Mn and at least 0.6 wt. % Fe, are contained within the aluminum alloy strip at such a level as to achieve a hypereutectic composition.

In some embodiments, the aluminum alloy strip may contain secondary elements, territory elements, and/or other elements. As used herein, "secondary elements" are Mg, Si Cu, and/or Zn. As used herein, "tertiary elements" is oxygen. As used herein, "other elements" includes any elements of the periodic table other than the above-identified elements, i.e., any elements other than aluminum (Al), Mn, Fe, Mg. Si, Cu, Zn and/or O. The secondary and tertiary elements may be present in the amounts shown below. The new aluminum alloy may include not more than 0.25 wt. % each of any other element, with the total combined amount of these other elements not exceeding 0.50 wt. % in the new aluminum alloy. In another embodiment, each one of these other elements, individually, does not exceed 0.15 wt. % in the aluminum alloy, and the total combined amount of these other elements does not exceed 0.35 wt. % in the aluminum alloy. In another embodiment, each one of these other elements, individually, does not exceed 0.10 wt. % in the aluminum alloy, and the total combined amount of these other elements does not exceed 0.25 wt. % in the aluminum alloy. In another embodiment, each one of these other elements, individually, does not exceed 0.05 wt. % in the aluminum alloy, and the total combined amount of these other elements does not exceed 0.15 wt. % in the aluminum alloy. In another embodiment, each one of these other elements, individually, does not exceed 0.03 wt. % in the aluminum alloy, and the total combined amount of these other elements does not exceed 0.10 wt. % in the aluminum alloy.

In one embodiment, the new alloy includes up to 3.0 wt. % Mg. In one embodiment, the new alloy includes 0.2-3.0 wt. % Mg. In one embodiment, the new aluminum alloy includes at least 0.40 wt. % Mg. In one embodiment, the new aluminum alloy includes at least 0.60 wt. % Mg. In one embodiment, the new aluminum alloy includes not greater than 2.0 wt. % Mg. In one embodiment, the new aluminum alloy includes not greater than 1.7 wt. % Mg. In one embodiment, the new aluminum alloy includes not greater than 1.5 wt. % Mg. In other embodiments, magnesium is included in the alloy as an impurity, and in these embodiments is present at levels of 0.19 wt. % Mg, or less. In some embodiments, the aluminum alloy strip has 0 wt. % Mg.

In one embodiment, the new aluminum alloy includes up to 1.5 wt. % Si. In one embodiment, the new aluminum alloy includes 0.1-1.5 wt. % Si. In one embodiment, the new aluminum alloy includes at least about 0.20 wt. % Si. In one embodiment, the new aluminum alloy includes at least about 0.30 wt. % Si. In one embodiment, the new aluminum alloy includes at least about 0.40 wt. % Si. In one embodiment, the new aluminum alloy includes not greater than about 1.0 wt. % Si. In one embodiment, the new aluminum alloy includes not greater than about 0.8 wt. % Si. In other embodiments, silicon is included in the alloy as an impurity, and in these embodiments is present at levels of 0.09 wt. % Si, or less. In some embodiments, the aluminum alloy strip has 0 wt. % Si.

In one embodiment, the new aluminum alloy includes up to 1.0 wt. % Cu. In one embodiment, the new aluminum alloy includes 0.1-1.0 wt. % Cu. In one embodiment, the new aluminum alloy includes at least about 0.15 wt. % Cu. In one embodiment, the new aluminum alloy includes at least about 0.20 wt. % Cu. In one embodiment, the new aluminum alloy includes at least about 0.25 wt. % Cu. In one embodiment, the new aluminum alloy includes at least about 0.30 wt. % Cu. In other embodiments, copper is included in the alloy as an impurity, and in these embodiments is present at levels of 0.09 wt. % Cu, or less. In some embodiments, the aluminum alloy strip has 0 wt. % Cu.

In one embodiment, the new includes up to 1.5 wt. % Zn, such as up to 1.25 wt. % Zn, or up to 1.0 wt. % Zn, or up to 0.50 wt. % Zn. In one embodiment, the new aluminum alloy includes zinc, and in these embodiments the new aluminum alloy includes at least 0.10 wt. % Zn. In one embodiment, the new aluminum alloy includes at least 0.25 wt. % Zn. In one embodiment, the new HT aluminum alloy includes at least 0.35 wt. % Zn. In other embodiments, zinc is included in the alloy as an impurity, and in these embodiments is present at levels of 0.09 wt. % Zn, or less. In some embodiments, the aluminum alloy strip has 0 wt. % Zn.

In some embodiments, the aluminum alloy strip has an oxygen content of 0.25 wt. % or less. In some embodiments, the aluminum alloy strip has an oxygen content of 0.2 wt. % or less. In some embodiments, the aluminum alloy strip has an oxygen content of 0.15 wt. % or less. In some embodiments, the aluminum alloy strip has an oxygen content of 0.1 wt. % or less. In an embodiment, the aluminum alloy strip has an oxygen content of 0.09 wt. % or less. In another embodiment, the aluminum alloy strip has an oxygen content of 0.08 wt. % or less. In yet another embodiment, the aluminum alloy strip has an oxygen content of 0.07 wt. % or less. In other embodiments, the aluminum alloy strip has an oxygen content of 0.06 wt. % or less. In some embodiments, the aluminum alloy strip has an oxygen content of 0.05 wt. % or less. In one embodiment, the aluminum alloy strip has an oxygen content of 0.04 wt. % or less. In another embodiment, the aluminum alloy strip has an oxygen content of 0.03 wt. % or less. In other embodiments, the aluminum alloy strip has an oxygen content of 0.02 wt. % or less. In some embodiments, the aluminum alloy strip has an oxygen content of 0.01 wt. % or less. In some embodiments, the aluminum alloy strip has an oxygen content of 0.005 wt. % or less. In some embodiments, the aluminum alloy strip has an oxygen content below the detection limit of the LECO Oxygen-Nitrogen Analyzer.

In some embodiments, the aluminum alloy strip is used as can sheet stock for producing can bodies and/or can ends or other can making applications. In these embodiments, the aluminum alloy strip may include:

from 0.8 to 8.0 wt. % Mn;
from 0.6 to 5.0 wt. % Fe;
from 0.15 to 1.0 wt. % Si;
from 0.15 to 1.0 wt. % Cu;
from 0.8 to 3.0 wt. % Mg;
up to 0.5 wt. % Zn; and
up to 0.05 wt. % oxygen;

the balance being aluminum, and other elements, wherein the aluminum alloy includes not greater than 0.25 wt. % of any one of the other elements, and wherein the aluminum alloy includes not greater than 0.50 wt. % total of the other elements.

In some embodiments, the aluminum alloy strip may include:

from 1 to 2.15 wt. % Mn;
from 0.55 to 1.8 wt. % Fe;
from 0.2 to 0.7 wt. % Si;
from 0.15 to 0.7 wt. % Cu; and/or
from 0.7 to 1.65 wt. % Mg; and the balance being aluminum, and other elements, wherein the aluminum alloy includes not greater than 0.25 wt. % of any one of the other elements, and wherein the aluminum alloy includes not greater than 0.50 wt. % total of the other elements.

In some embodiments, the near surface of the aluminum alloy strip is substantially free of large particles having an equivalent diameter of at least 50 micrometers. In some embodiments, the near surface of the aluminum alloy strip is substantially free of large particles having an equivalent diameter of at least 40 micrometers. In some embodiments, the near surface of the aluminum alloy strip is substantially free of large particles having an equivalent diameter of at least 30 micrometers. In some embodiments, the near surface of the aluminum alloy strip is substantially free of large particles having an equivalent diameter of at least 25 micrometers. In some embodiments, the near surface of the aluminum alloy strip is substantially free of large particles having an equivalent diameter of at least 20 micrometers. In some embodiments, the near surface of the aluminum alloy strip is substantially free of large particles having an equivalent diameter of at least 15 micrometers. In some embodiments, the near surface of the aluminum alloy strip is substantially free of large particles having an equivalent diameter of at least 10 micrometers. In some embodiments, the near surface of the aluminum alloy strip is substantially free of large particles having an equivalent diameter of at least 5 micrometers. In some embodiments, the near surface of the aluminum alloy strip is substantially free of large particles having an equivalent diameter of at least 4 micrometers. In some embodiments, the near surface of the aluminum alloy strip is substantially free of large particles having an equivalent diameter of at least 3 micrometers.

In some embodiments, the near surface of the aluminum alloy strip is substantially free of large particles having an equivalent diameter ranging from 3 micrometers to 50 micrometers. In some embodiments, the near surface of the aluminum alloy strip is substantially free of large particles having an equivalent diameter ranging from 3 micrometers to 40 micrometers. In some embodiments, the near surface of the aluminum alloy strip is substantially free of large particles ranging from 3 micrometers to 30 micrometers. In some embodiments, the near surface of the aluminum alloy strip is substantially free of large particles ranging from 3 micrometers to 20 micrometers. In some embodiments, the near surface of the aluminum alloy strip is substantially free of large particles ranging from 3 micrometers to 10 micrometers. In some embodiments, the near surface of the aluminum alloy strip is substantially free of large particles ranging from 3 micrometers to 5 micrometers. In some embodiments, the near surface of the aluminum alloy strip is substantially free of large particles ranging from 5 micrometers to 50 micrometers. In some embodiments, the near surface of the aluminum alloy strip is substantially free of large particles ranging from 10 micrometers to 50 micrometers. In some embodiments, the near surface of the aluminum alloy strip is substantially free of large particles ranging from 20 micrometers to 50 micrometers. In some embodiments, the near surface of the aluminum alloy strip is substantially free of large particles ranging from 30 micrometers to 50 micrometers. In some embodiments, the near surface of the aluminum alloy strip is substantially free of large particles ranging from 40 micrometers to 50 micrometers.

In some embodiments, when cupping and ironing a strip that is substantially free of large particles, the ironing die requires cleaning after about 3000 cans. In some embodiments, when cupping and ironing a strip that is substantially free of large particles, the ironing die requires cleaning after about 2500 cans. In some embodiments, when cupping and ironing a strip that is substantially free of large particles, the ironing die requires cleaning after about 2000 cans. In some embodiments, when cupping and ironing a strip that is substantially free of large particles, the ironing die requires cleaning after about 1500 cans. In some embodiments, when cupping and ironing a strip that is substantially free of large particles, the ironing die requires cleaning after about 1000 cans. In some embodiments, when cupping and ironing a strip that is substantially free of large particles, the ironing die requires cleaning after about 500 cans. In some embodiments, when cupping and ironing a strip that is substantially free of large particles, the ironing die requires cleaning after about 300 cans. In some embodiments, when cupping and ironing a strip that is substantially free of large particles, the ironing die requires cleaning after about 200 cans. In some embodiments, when cupping and ironing a strip that is substantially free of large particles, the ironing die requires cleaning after about 100 cans.

In some embodiments, when cupping and ironing a strip that is substantially free of large particles, the ironing die requires cleaning at a particular frequency. As used herein, the "particular cleaning frequency" means a number of cleanings per unit time. Thus, a lower "particular cleaning frequency" corresponds to a larger time interval between cleanings. In some embodiments, the particular frequency of die cleaning associated with cupping and ironing a strip that is substantially free of large particles is equal to or less than a particular cleaning frequency associated with cupping and ironing a strip that is not substantially free of large particles. In some embodiments, the particular frequency of die cleaning associated with cupping and ironing a strip that is substantially free of large particles is at least 10% less than a particular cleaning frequency associated with cupping and ironing a strip that is not substantially free of large particles. In some embodiments, the particular frequency of die cleaning associated with cupping and ironing a strip that is substantially free of large particles is at least 20% less than a particular cleaning frequency associated with cupping and ironing a strip that is not substantially free of large particles. In some embodiments, the particular frequency of die cleaning associated with cupping and ironing a strip that is substantially free of large particles is at least 30% less than a particular cleaning frequency associated with cupping and ironing a strip that is not substantially free of large particles.

In some embodiments, the particular frequency of die cleaning associated with cupping and ironing a strip that is substantially free of large particles is at least 40% less than a particular cleaning frequency associated with cupping and ironing a strip that is not substantially free of large particles. In some embodiments, the particular frequency of die cleaning associated with cupping and ironing a strip that is substantially free of large particles is at least 50% less than a particular cleaning frequency associated with cupping and ironing a strip that is not substantially free of large particles. In some embodiments, the particular frequency of die cleaning associated with cupping and ironing a strip that is substantially free of large particles is at least 70% less than a particular cleaning frequency associated with cupping and ironing a strip that is not substantially free of large particles. In some embodiments, the particular frequency of die cleaning associated with cupping and ironing a strip that is substantially free of large particles is at least 80% less than a particular cleaning frequency associated with cupping and ironing a strip that is not substantially free of large particles. In some embodiments, the particular frequency of die cleaning associated with cupping and ironing a strip that is substantially free of large particles is at least 90% less than a particular cleaning frequency associated with cupping and ironing a strip that is not substantially free of large particles.

In some embodiments, the near surface of the aluminum alloy strip includes small particles. In some embodiments, the near surface of the aluminum alloy strip is substantially free of large particles and includes a sufficient particle count per unit area and/or sufficient volume fraction of small particles such that, when cupping and ironing the strip, the ironing die requires cleaning after about 3000 cans. In some embodiments, the near surface of the aluminum alloy strip is substantially free of large particles and includes a sufficient particle count per unit area and/or sufficient volume fraction of small particles such that, when cupping and ironing the strip, the ironing die requires cleaning after about 2500 cans. In some embodiments, the near surface of the aluminum alloy strip is substantially free of large particles and includes a sufficient particle count per unit area and/or sufficient volume fraction of small particles such that, when cupping and ironing the strip, the ironing die requires cleaning after about 2000 cans. In some embodiments, the near surface of the aluminum alloy strip is substantially free of large particles and includes a sufficient particle count per unit area and/or sufficient volume fraction of small particles such that, when cupping and ironing the strip, the ironing die requires cleaning after about 1500 cans. In some embodiments, the near surface of the aluminum alloy strip is substantially free of large particles and includes a sufficient particle count per unit area and/or sufficient volume fraction of small particles such that, when cupping and ironing the strip, the ironing die requires cleaning after about 1000 cans. In some embodiments, the near surface of the aluminum alloy strip is substantially free of large particles and includes a sufficient particle count per unit area and/or sufficient volume fraction of small particles such that, when cupping and ironing the strip, the ironing die requires cleaning after about 500 cans. In some embodiments, the near surface of the aluminum alloy strip is substantially free of large particles and includes a sufficient particle count per unit area and/or sufficient volume fraction of small particles such that, when cupping and ironing the strip, the ironing die requires cleaning after about 300 cans. In some embodiments, the near surface of the aluminum alloy strip is substantially free of large particles and includes a sufficient particle count per unit area and/or sufficient volume fraction of small particles such that, when cupping and ironing the strip, the ironing die requires cleaning after about 200 cans. In some embodiments, the near surface of the aluminum alloy strip is substantially free of large particles and includes a sufficient particle count per unit area and/or sufficient volume fraction of small particles such that, when cupping and ironing the strip, the ironing die requires cleaning after about 100 cans.

In some embodiments, when cupping and ironing a strip that is substantially free of large particles and has a particle count per unit area and/or volume fraction of small particles as described herein, the ironing die requires cleaning at a particular frequency. In some embodiments, the particular frequency of die cleaning associated with cupping and ironing a strip that is substantially free of large particles and has a particle count per unit area and/or volume fraction of small particles as described herein is equal to or less than a particular cleaning frequency associated with cupping and ironing a strip that is not substantially free of large particles. In some embodiments, the particular frequency of die cleaning associated with cupping and ironing a strip that is substantially free of large particles and has a particle count per unit area and/or volume fraction of small particles as described herein is at least 10% less than a particular cleaning frequency associated with cupping and ironing a strip that is not substantially free of large particles. In some embodiments, the particular frequency of die cleaning associated with cupping and ironing a strip that is substantially free of large particles and has a particle count per unit area and/or volume fraction of small particles as described herein is at least 20% less than a particular cleaning frequency associated with cupping and ironing a strip that is not substantially free of large particles. In some embodiments, the particular frequency of die cleaning associated with cupping and ironing a strip that is substantially free of large particles and has a particle count per unit area and/or volume fraction of small particles as described herein is at least 30% less than a particular cleaning frequency associated with cupping and ironing a strip that is not substantially free of large particles.

In some embodiments, the particular frequency of die cleaning associated with cupping and ironing a strip that is substantially free of large particles and has a particle count per unit area and/or volume fraction of small particles as described herein is at least 40% less than a particular cleaning frequency associated with cupping and ironing a strip that is not substantially free of large particles. In some embodiments, the particular frequency of die cleaning associated with cupping and ironing a strip that is substantially free of large particles and has a particle count per unit area and/or volume fraction of small particles as described herein is at least 50% less than a particular cleaning frequency associated with cupping and ironing a strip that is not substantially free of large particles. In some embodiments, the particular frequency of die cleaning associated with cupping and ironing a strip that is substantially free of large particles and has a particle count per unit area and/or volume fraction of small particles as described herein is at least 70% less than a particular cleaning frequency associated with cupping and ironing a strip that is not substantially free of large particles. In some embodiments, the particular frequency of die cleaning associated with cupping and ironing a strip that is substantially free of large particles and has a particle count per unit area and/or volume fraction of small particles as described herein is at least 80% less than a particular cleaning frequency associated with cupping and ironing a strip that is not substantially free of large particles. In some embodiments, the particular frequency of die cleaning associated with cupping and ironing a strip that is substantially free of large particles and has a particle count per unit area and/or volume fraction of small particles as described herein is at least 90% less than a particular cleaning frequency associated with cupping and ironing a strip that is not substantially free of large particles.

In an embodiment, each of the small particles has a particular equivalent diameter. In one embodiment, the particular equivalent diameter is less than 3 micrometers. In another embodiment, the particular equivalent diameter is less than 2.9 micrometers. In another embodiment, the particular equivalent diameter is less than 2.8 micrometers. In another embodiment, the particular equivalent diameter is less than 2.7 micrometers. In one embodiment, the particular equivalent diameter is less than 2.6 micrometers. In another embodiment, the particular equivalent diameter is less than 2.5 micrometer. In one embodiment, the particular equivalent diameter is less than 2.4 micrometers. In one embodiment, the particular equivalent diameter is less than 2.3 micrometers. In one embodiment, the particular equivalent diameter is less than 2.2 micrometers. In one embodiment, the particular equivalent diameter is less than 2.1 micrometers. In one embodiment, the particular equivalent diameter is less than 2 micrometers.

In an embodiment, each of the small particles has a particular equivalent diameter ranging from 0.22 microns to 3 micrometers. In another embodiment, the particular equivalent diameter ranges from 0.22 microns to 2.9 micrometers. In another embodiment, the particular equivalent diameter ranges from 0.22 microns to 2.8 micrometers. In another embodiment, the particular equivalent diameter ranges from 0.22 microns to 2.7 micrometers. In another embodiment, the particular equivalent diameter ranges from 0.22 microns to 2.6 micrometers. In another embodiment, the particular equivalent diameter ranges from 0.22 microns to 2.5 micrometers. In another embodiment, the particular equivalent diameter ranges from 0.22 microns to 2.4 micrometers. In another embodiment, the particular equivalent diameter ranges from 0.22 microns to 2.3 micrometers. In another embodiment, the particular equivalent diameter ranges from 0.22 microns to 2.2 micrometers. In another embodiment, the particular equivalent diameter ranges from 0.22 microns to 2.1 micrometers. In another embodiment, the particular equivalent diameter ranges from 0.22 microns to 2 micrometers. In another embodiment, the particular equivalent diameter ranges from 0.22 microns to 0.35 micrometers.

In one embodiment, the particular equivalent diameter is at least 0.22 micrometers. In another embodiment, the particular equivalent diameter is at least 0.3 micrometers. In another embodiment, the particular equivalent diameter is at least 0.35 micrometers. In another embodiment, the particular equivalent diameter is at least 0.5 micrometers. In one embodiment, the particular equivalent diameter is at least 0.7 micrometers. In another embodiment, the particular equivalent diameter is at least 0.8 micrometer. In one embodiment, the particular equivalent diameter is at least 0.9 micrometers.

In some embodiments, the quantity per unit area of the small particles having a particular equivalent diameter is at least 0.007 particles per square micrometer at the near surface of the aluminum alloy strip. In the one embodiment, the quantity per unit area of the small particles having a particular equivalent diameter is at least 0.008 particles per square micrometer at the near surface of the aluminum alloy strip. In the one embodiment, the quantity per unit area of the small particles having a particular equivalent diameter is at least 0.009 particles per square micrometer at the near surface of the aluminum alloy strip. In the one embodiment, the quantity per unit area of the small particles having a particular equivalent diameter is at least 0.01 particles per square micrometer at the near surface of the aluminum alloy strip. In another embodiment, the quantity per unit area of the small particles having a particular equivalent diameter is at least 0.02 particles per square micrometer at the near surface of the aluminum alloy strip.

In another embodiment, the quantity per unit area of the small particles having a particular equivalent diameter is at least 0.03 particles per square micrometer at the near surface of the aluminum alloy strip. In another embodiment, the quantity per unit area of the small particles having a particular equivalent diameter is at least 0.04 particles per square micrometer at the near surface of the aluminum alloy strip. In another embodiment, the quantity per unit area of the small particles having a particular equivalent diameter is at least 0.046 particles per square micrometer at the near surface of the aluminum alloy strip. In another embodiment, the quantity per unit area of the small particles having a particular equivalent diameter is at least 0.05 particles per square micrometer at the near surface of the aluminum alloy strip. In another embodiment, the quantity per unit area of the small particles having a particular equivalent diameter is at least 0.06 particles per square micrometer at the near surface of the aluminum alloy strip.

In some embodiments, the quantity per unit area of the small particles having a particular equivalent diameter ranges from 0.007 to 0.06 particles per square micrometer at the near surface of the aluminum alloy strip. In some embodiments, the quantity per unit area of the small particles having a particular equivalent diameter ranges from 0.009 to 0.06 particles per square micrometer at the near surface of the aluminum alloy strip. In some embodiments, the quantity per unit area of the small particles having a particular equivalent diameter ranges from 0.01 to 0.06 particles per square micrometer at the near surface of the aluminum alloy strip. In some embodiments, the quantity per unit area of the small particles having a particular equivalent diameter ranges from 0.015 to 0.06 particles per square micrometer at the near surface of the aluminum alloy strip. In some embodiments, the quantity per unit area of the small particles having a particular equivalent diameter ranges from 0.02 to 0.06 particles per square micrometer at the near surface of the aluminum alloy strip. In some embodiments, the quantity per unit area of the small particles having a particular equivalent diameter ranges from 0.025 to 0.06 particles per square micrometer at the near surface of the aluminum alloy strip. In some embodiments, the quantity per unit area of the small particles having a particular equivalent diameter ranges from 0.03 to 0.06 particles per square micrometer at the near surface of the aluminum alloy strip. In some embodiments, the quantity per unit area of the small particles having a particular equivalent diameter ranges from 0.035 to 0.06 particles per square micrometer at the near surface of the aluminum alloy strip. In some embodiments, the quantity per unit area of the small particles having a particular equivalent diameter ranges from 0.04 to 0.06 particles per square micrometer at the near surface of the aluminum alloy strip. In some embodiments, the quantity per unit area of the small particles having a particular equivalent diameter ranges from 0.043 to 0.055 particles per square micrometer at the near surface of the aluminum alloy strip. In some embodiments, the quantity per unit area of the small particles having a particular equivalent diameter ranges from 0.043 to 0.06 particles per square micrometer at the near surface of the aluminum alloy strip.

In some embodiments, the quantity per unit area of the small particles having a particular equivalent diameter of 0.33 micrometers is at least 0.003 particles per square micrometer at the near surface of the aluminum alloy strip. In some embodiments, the quantity per unit area of the small particles having a particular equivalent diameter of 0.33 micrometers is at least 0.01 particles per square micrometer at the near surface of the aluminum alloy strip. In some embodiments, the quantity per unit area of the small particles having a particular equivalent diameter of 0.33 micrometers is at least 0.043 particles per square micrometer at the near surface of the aluminum alloy strip.

In some embodiments, the quantity per unit area of the small particles having a particular equivalent diameter of 0.33 micrometers ranges from 0.003 to 0.06 particles per square micrometer at the near surface of the aluminum alloy strip. In some embodiments, the quantity per unit area of the small particles having a particular equivalent diameter of 0.33 micrometers ranges from 0.01 to 0.06 particles per square micrometer at the near surface of the aluminum alloy strip. In some embodiments, the quantity per unit area of the small particles having a particular equivalent diameter of 0.33 micrometers from 0.043 to 0.06 particles per square micrometer at the near surface of the aluminum alloy strip.

In some embodiments, the quantity per unit area of the small particles having a particular equivalent diameter of 0.5 micrometers is at least 0.003 particles per square micrometer at the near surface of the aluminum alloy strip. In some embodiments, the quantity per unit area of the small particles having a particular equivalent diameter of 0.5 micrometers is at least 0.01 particles per square micrometer at the near surface of the aluminum alloy strip. In some embodiments, the quantity per unit area of the small particles having a particular equivalent diameter of 0.5 micrometers is at least 0.03 particles per square micrometer at the near surface of the aluminum alloy strip. In some embodiments, the quantity per unit area of the small particles having a particular equivalent diameter of 0.5 micrometers is at least 0.035 particles per square micrometer at the near surface of the aluminum alloy strip. In some embodiments, the quantity per unit area of the small particles having a particular equivalent diameter of 0.5 micrometers is at least 0.04 particles per square micrometer at the near surface of the aluminum alloy strip. In some embodiments, the quantity per unit area of the small particles having a particular equivalent diameter of 0.5 micrometers is at least 0.043 particles per square micrometer at the near surface of the aluminum alloy strip.

In some embodiments, the quantity per unit area of the small particles having a particular equivalent diameter of 0.5 micrometers ranges from 0.003 to 0.06 particles per square micrometer at the near surface of the aluminum alloy strip. In some embodiments, the quantity per unit area of the small particles having a particular equivalent diameter of 0.5 micrometers ranges from 0.01 to 0.06 particles per square micrometer at the near surface of the aluminum alloy strip. In some embodiments, the quantity per unit area of the small particles having a particular equivalent diameter of 0.5 micrometers from 0.03 to 0.045 particles per square micrometer at the near surface of the aluminum alloy strip.

In some embodiments, the quantity per unit area of the small particles having a particular equivalent diameter in the range of 0.33 to 0.5 micrometers is at least 0.003 particles per square micrometer at the near surface of the aluminum alloy strip. In some embodiments, the quantity per unit area of the small particles having a particular equivalent diameter in the range of 0.33 to 0.5 micrometers is at least 0.01 particles per square micrometer at the near surface of the aluminum alloy strip. In some embodiments, the quantity per unit area of the small particles having a particular equivalent diameter in the range of 0.33 to 0.5 micrometers is at least 0.043 particles per square micrometer at the near surface of the aluminum alloy strip.

In some embodiments, the quantity per unit area of the small particles having a particular equivalent diameter in the range of 0.33 to 0.5 micrometers ranges from 0.003 to 0.06 particles per square micrometer at the near surface of the aluminum alloy strip. In some embodiments, the quantity per unit area of the small particles having a particular equivalent diameter in the range of 0.33 to 0.5 micrometers ranges from 0.01 to 0.06 particles per square micrometer at the near surface of the aluminum alloy strip. In some embodiments, the quantity per unit area of the small particles having a particular equivalent diameter in the range 0.33 to 0.5 micrometers from 0.043 to 0.055 particles per square micrometer at the near surface of the aluminum alloy strip.

In some embodiments, the near surface of the aluminum alloy strip includes small particles. In an embodiment, each of the small particles has a particular equivalent diameter. In some embodiments, the volume fraction of the small particles having a particular equivalent diameter is at least 0.1 percent at the near surface of the aluminum alloy strip. In some embodiments, the volume fraction of the small particles having a particular equivalent diameter is at least 0.2 percent at the near surface of the aluminum alloy strip. In some embodiments, the volume fraction of the small particles having a particular equivalent diameter is at least 0.3 percent at the near surface of the aluminum alloy strip. In some embodiments, the volume fraction of the small particles having a particular equivalent diameter is at least 0.4 percent at the near surface of the aluminum alloy strip. In some embodiments, the volume fraction of the small particles having a particular equivalent diameter is at least 0.5 percent at the near surface of the aluminum alloy strip. In some embodiments, the volume fraction of the small particles having a particular equivalent diameter is at least 0.6 percent at the near surface of the aluminum alloy strip. In some embodiments, the volume fraction of the small particles having a particular equivalent diameter is at least 0.65 percent at the near surface of the aluminum alloy strip. In some embodiments, the volume fraction of the small particles having a particular equivalent diameter is at least 0.7 percent at the near surface of the aluminum alloy strip. In some embodiments, the volume fraction of the small particles having a particular equivalent diameter is at least 0.8 percent at the near surface of the aluminum alloy strip. In some embodiments, the volume fraction of the small particles having a particular equivalent diameter is at least 0.9 percent at the near surface of the aluminum alloy strip. In some embodiments, the volume fraction of the small particles having a particular equivalent diameter is at least 1.0 percent at the near surface of the aluminum alloy strip. In some embodiments, the volume fraction of the small particles having a particular equivalent diameter is at least 1.1 percent at the near surface of the aluminum alloy strip. In some embodiments, the volume fraction of the small particles having a particular equivalent diameter is at least 1.2 percent at the near surface of the aluminum alloy strip.

In some embodiments, the volume fraction of the small particles having a particular equivalent diameter ranges from 0.1 percent to 1.2 at the near surface of the aluminum alloy strip. In some embodiments, the volume fraction of the small particles having a particular equivalent diameter ranges from 0.2 percent to 1.2 at the near surface of the aluminum alloy strip. In some embodiments, the volume fraction of the small particles having a particular equivalent diameter ranges from 0.3 percent to 1.2 at the near surface of the aluminum alloy strip. In some embodiments, the volume fraction of the small particles having a particular equivalent diameter ranges from 0.4 percent to 1.2 at the near surface of the aluminum alloy strip. In some embodiments, the volume fraction of the small particles having a particular equivalent diameter ranges from 0.5 percent to 1.2 at the near surface of the aluminum alloy strip. In some embodiments, the volume fraction of the small particles having a particular equivalent diameter ranges from 0.6 percent to 1.2 at the near surface of the aluminum alloy strip. In some embodiments, the volume fraction of the small particles having a particular equivalent diameter ranges from 0.7 percent to 1.2 at the near surface of the aluminum alloy strip. In some embodiments, the volume fraction of the small particles having a particular equivalent diameter ranges from 0.8 percent to 1.2 at the near surface of the aluminum alloy strip. In some embodiments, the volume fraction of the small particles having a particular equivalent diameter ranges from 0.9 percent to 1.2 at the near surface of the aluminum alloy strip.

In some embodiments, the particular equivalent diameter is less than 1 micrometer and the volume fraction of the small particles having that particular equivalent diameter is at least 0.2 percent at the near surface of the aluminum alloy strip. In some embodiments, the particular equivalent diameter is less than 0.9 micrometer and the volume fraction of the small particles having that particular equivalent diameter is at least 0.2 percent at the near surface of the aluminum alloy strip. In some embodiments, the particular equivalent diameter is less than 0.85 micrometer and the volume fraction of the small particles having that particular equivalent diameter is at least 0.2 percent at the near surface of the aluminum alloy strip. In some embodiments, the particular equivalent diameter is less than 0.8 micrometer and the volume fraction of the small particles having that particular equivalent diameter is at least 0.2 percent at the near surface of the aluminum alloy strip. In some embodiments, the particular equivalent diameter is less than 0.7 micrometer and the volume fraction of the small particles having that particular equivalent diameter is at least 0.1 percent at the near surface of the aluminum alloy strip. In some embodiments, the particular equivalent diameter is less than 0.6 micrometer and the volume fraction of the small particles having that particular equivalent diameter is at least 0.1 percent at the near surface of the aluminum alloy strip.

In some embodiments, the particular equivalent diameter ranges from 0.5 to 0.85 and the volume fraction of the small particles having the particular equivalent diameter is at least 0.2 percent at the near surface of the aluminum alloy strip. In some embodiments, the particular equivalent diameter ranges from 0.5 to 0.85 and the volume fraction of the small particles having the particular equivalent diameter is at least 0.4 percent at the near surface of the aluminum alloy strip. In some embodiments, the particular equivalent diameter ranges from 0.5 to 0.85 and the volume fraction of the small particles having the particular equivalent diameter is at least 0.65 percent at the near surface of the aluminum alloy strip.

In some embodiments, the particular equivalent diameter is less than 0.85 and the volume fraction of the small particles having the particular equivalent diameter is at least 0.2 percent at the near surface of the aluminum alloy strip. In some embodiments, the particular equivalent diameter ranges is less than 0.85 and the volume fraction of the small particles having the particular equivalent diameter is at least 0.4 percent at the near surface of the aluminum alloy strip. In some embodiments, the particular equivalent diameter is less than 0.85 and the volume fraction of the small particles having the particular equivalent diameter is at least 0.8 percent at the near surface of the aluminum alloy strip.

In some embodiments, the aluminum alloy strip has the particle count per unit area profile shown in FIG. 3. In some embodiments, the aluminum alloy strip has the volume fraction profile shown in FIG. 4.

B. Properties

In some embodiments, when the aluminum alloy strip and a reference material are exposed to a room temperature of 75° F., the properties of the aluminum alloy strip and reference material are constant over varying durations of exposure. In these embodiments, the properties of the aluminum alloy strip and reference material exposed to a room temperature of 75° F. for 1 hour are substantially the same as the properties of the aluminum alloy strip and reference material exposed to a room temperature of 75° F. for 500 hours or more. In some embodiments, when the aluminum alloy strip and a reference material are exposed to a temperature of at least 75° F. for 100 hours, a first tensile yield strength of the aluminum alloy strip is greater than a second tensile yield strength of the reference material. In some embodiments, the reference material is an aluminum alloy 2219 having a T87 temper. In an embodiments, when the aluminum alloy strip and the reference material are exposed to a temperature of at least 75° F. for 100 hours, the first tensile yield strength of the aluminum alloy strip is at least 5% greater than the second tensile yield strength of the reference material. In an embodiment, when the aluminum alloy strip and the reference material are exposed to a temperature of at least 75° F. for 100 hours, the first tensile yield strength of the aluminum alloy strip is at least 10% greater than the second tensile yield strength of the reference material. In another embodiment, when the aluminum alloy strip and the reference material are exposed to a temperature of at least 75° F. for 100 hours, the first tensile yield strength of the aluminum alloy strip is at least 15% greater than the second tensile yield strength of the reference material. In another embodiment, when the aluminum alloy strip and the reference material are exposed to a temperature of at least 75° F. for 100 hours, the first tensile yield strength of the aluminum alloy strip is at least 20% greater than the second tensile yield strength of the reference material. In another embodiment, when the aluminum alloy strip and the reference material are exposed to a temperature of at least 75° F. for 100 hours, the first tensile yield strength of the aluminum alloy strip is at least 25% greater than the second tensile yield strength of the reference material. It is expected that exposing the aluminum alloy strip of some embodiments of the present invention and the aluminum alloy 2219 having a T87 temper reference material at 75° F. for 500 hours will yield similar relative results as those detailed above for exposure at 75° F. for 100 hours. For example, in an embodiment, the aluminum alloy strip and the reference material are exposed to a temperature of at least 75° F. for 500 hours, the first tensile yield strength of the aluminum alloy strip is at least 5% greater than the second tensile yield strength of the reference material.

In some embodiments, when the aluminum alloy strip and a reference material are exposed to a temperature of 350° F.

for 100 hours, a first tensile yield strength of the aluminum alloy strip is greater than a second tensile yield strength of the reference material. In some embodiments, when the aluminum alloy strip and a reference material are exposed to a temperature of 400° F. for 100 hours, a first tensile yield strength of the aluminum alloy strip is greater than a second tensile yield strength of the reference material. In some embodiments, when the aluminum alloy strip and a reference material are exposed to a temperature of 450° F. for 100 hours, a first tensile yield strength of the aluminum alloy strip is greater than a second tensile yield strength of the reference material. It is expected that exposing the aluminum alloy strip of some embodiments of the present invention and the aluminum alloy 2219 having a T87 temper reference material at 350° F., 400° F., or 450° F. for 500 hours will yield similar relative results as those detailed above for exposure at 350° F., 400° F., or 450° F. for 100 hours. For example, in an embodiment, the aluminum alloy strip and the reference material are exposed to a temperature of 350° F., 400° F., or 450° F. for 500 hours, the first tensile yield strength of the aluminum alloy strip is greater than the second tensile yield strength of the reference material.

In some embodiments, when the aluminum alloy strip is exposed to a temperature of at least 75° F. for 500 hours, a tensile yield strength of the aluminum alloy strip is at least 35 ksi as measured by ASTM E8. In some embodiments, when the aluminum alloy strip is exposed to a temperature of at least 75° F. for 500 hours, a tensile yield strength of the aluminum alloy strip is at least 40 ksi as measured by ASTM E8. In some embodiments, when the aluminum alloy strip is exposed to a temperature of at least 75° F. for 500 hours, a tensile yield strength of the aluminum alloy strip is at least 45 ksi as measured by ASTM E8. In some embodiments, when the aluminum alloy strip is exposed to a temperature of at least 75° F. for 500 hours, a tensile yield strength of the aluminum alloy strip is at least 50 ksi as measured by ASTM E8.

In some embodiments, when the aluminum alloy strip is exposed to a temperature of 75° F. for 500 hours, a tensile yield strength of the aluminum alloy strip is at least 50 ksi as measured by ASTM E8. In some embodiments, when the aluminum alloy strip is exposed to a temperature of 75° F. for 500 hours, a tensile yield strength of the aluminum alloy strip is at least 55 ksi as measured by ASTM E8.

In some embodiments, when the aluminum alloy strip is exposed to a temperature of 350° F. for 500 hours, a tensile yield strength of the aluminum alloy strip is at least 45 ksi as measured by ASTM E8. In some embodiments, when the aluminum alloy strip is exposed to a temperature of 350° F. for 500 hours, a tensile yield strength of the aluminum alloy strip is at least 50 ksi as measured by ASTM E8.

In some embodiments, when the aluminum alloy strip is exposed to a temperature of 400° F. for 500 hours, a tensile yield strength of the aluminum alloy strip is at least 40 ksi as measured by ASTM E8. In some embodiments, when the aluminum alloy strip is exposed to a temperature of 400° F. for 500 hours, a tensile yield strength of the aluminum alloy strip is at least 45 ksi as measured by ASTM E8.

In some embodiments, when the aluminum alloy strip is exposed to a temperature of 450° F. for 500 hours, a tensile yield strength of the aluminum alloy strip is at least 35 ksi as measured by ASTM E8. In some embodiments, when the aluminum alloy strip is exposed to a temperature of 450° F. for 500 hours, a tensile yield strength of the aluminum alloy strip is at least 40 ksi as measured by ASTM E8.

In some embodiments, when the aluminum alloy strip is exposed to a particular temperature of greater than 75° F. for 500 hours, an elevated temperature tensile yield strength of the aluminum alloy strip is at least 15 ksi as measured by ASTM E21 at the particular temperature. In some embodiments, when the aluminum alloy strip is exposed to a temperature greater than 75° F. for 500 hours, an elevated temperature tensile yield strength of the aluminum alloy strip is at least 20 ksi as measured by ASTM E21 at the particular temperature. In some embodiments, when the aluminum alloy strip is exposed to a temperature of greater than 75° F. for 500 hours, an elevated temperature tensile yield strength of the aluminum alloy strip is at least 25 ksi as measured by ASTM E21 at the particular temperature. In some embodiments, when the aluminum alloy strip is exposed to a temperature of greater than 75° F. for 500 hours, an elevated temperature tensile yield strength of the aluminum alloy strip is at least 30 ksi as measured by ASTM E21 at the particular temperature. In some embodiments, when the aluminum alloy strip is exposed to a temperature of greater than 75° F. for 500 hours, an elevated temperature tensile yield strength of the aluminum alloy strip is at least 35 ksi as measured by ASTM E21 at the particular temperature.

In some embodiments, when the aluminum alloy strip is exposed to a temperature of 350° F. for 500 hours, an elevated temperature tensile yield strength of the aluminum alloy strip is at least 35 ksi as measured by ASTM E21 at 350° F. In some embodiments, when the aluminum alloy strip is exposed to a temperature of 350° F. for 500 hours, an elevated temperature tensile yield strength of the aluminum alloy strip is at least 40 ksi as measured by ASTM E21 at 350° F.

In some embodiments, when the aluminum alloy strip is exposed to a temperature of 400° F. for 500 hours, an elevated temperature tensile yield strength of the aluminum alloy strip is at least 20 ksi as measured by ASTM E21 at 400° F. In some embodiments, when the aluminum alloy strip is exposed to a temperature of 400° F. for 500 hours, an elevated temperature tensile yield strength of the aluminum alloy strip is at least 25 ksi as measured by ASTM E21 at 400° F.

In some embodiments, when the aluminum alloy strip is exposed to a temperature of 450° F. for 500 hours, an elevated temperature tensile yield strength of the aluminum alloy strip is at least 10 ksi as measured by ASTM E21 at 450° F. In some embodiments, when the aluminum alloy strip is exposed to a temperature of 450° F. for 500 hours, an elevated temperature tensile yield strength of the aluminum alloy strip is at least 15 ksi as measured by ASTM E21 at 450° F.

In some embodiments, the aluminum alloy strip includes the properties shown in FIGS. 5 to 8.

Method for Producing Aluminum Alloy Strip

Figure 9:
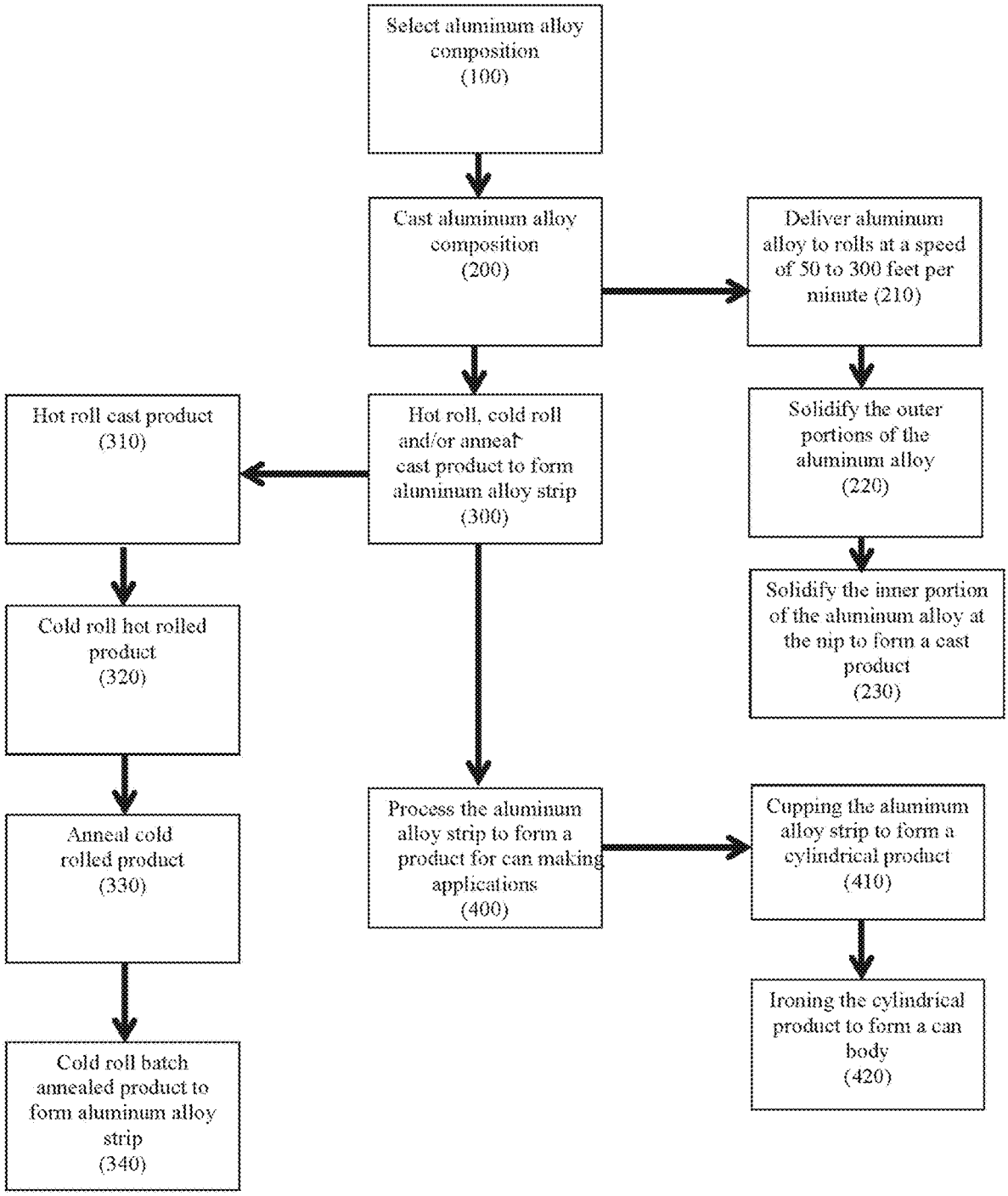
FIG. 9 illustrates an embodiment of a method for producing an aluminum alloy strip.

One embodiment of a method for producing new aluminum alloy strip is illustrated in FIG. 9. In the illustrated embodiment, an aluminum alloy composition is selected (100) having the composition described herein. The aluminum alloy is then continuously cast (200), after which it is hot rolled (310), cold rolled (320), batch annealed (330) and cold rolled (340) to form an aluminum alloy strip. After the cold rolling step (340), the aluminum alloy strip may be subjected to additional processing (400) to form a product configured for can making applications. In an embodiment, the product may include a can body or end. In an embodiment, the processing (400) may include a cupping (410) and/or ironing (420) to form a can body.

A. Continuous Casting

The continuously casting step (200) (also referred to as "casting" or "the casting step") may be accomplished via any continuous casting apparatus capable of producing continuously cast products that are solidified at high solidification rates. High solidification rates facilitate retention of alloying elements in solid solution. The solid solution formed at high temperature may be retained in a supersaturated state by cooling with sufficient rapidity to restrict the precipitation of the solute atoms as coarse, incoherent particles. In one embodiment, the solidification rate is such that the alloy realizes a secondary dendrite arm spacing of 10 micrometers, or less (on average). In one embodiment, the secondary dendrite arm spacing is not greater than 7 micrometers. In another embodiment, the secondary dendrite arm spacing is not greater than 5 micrometers. In yet another embodiment, the secondary dendrite arm spacing is not greater than 3 micrometers. One example of a continuous casting apparatus capable of achieving the above-described solidification rates is the apparatus described in U.S. Pat. Nos. 5,496,423 and 6,672,368. In these apparatus, the cast product typically exits the rolls of the casting at about 1100° F. It may be desirable to lower the cast product temperature to about 1000° F. within about 8 to 10 inches of the nip of the rolls to achieve the above-described solidification rates. In an embodiment, the nip of the rolls may be a point of minimum clearance between the rolls.

In an embodiment, the alloy is continuously cast using the process described in U.S. Pat. Nos. 5,496,423 and 6,672,368 and hereby incorporated by reference herein in its entirety for all purposes.

Figure 10:
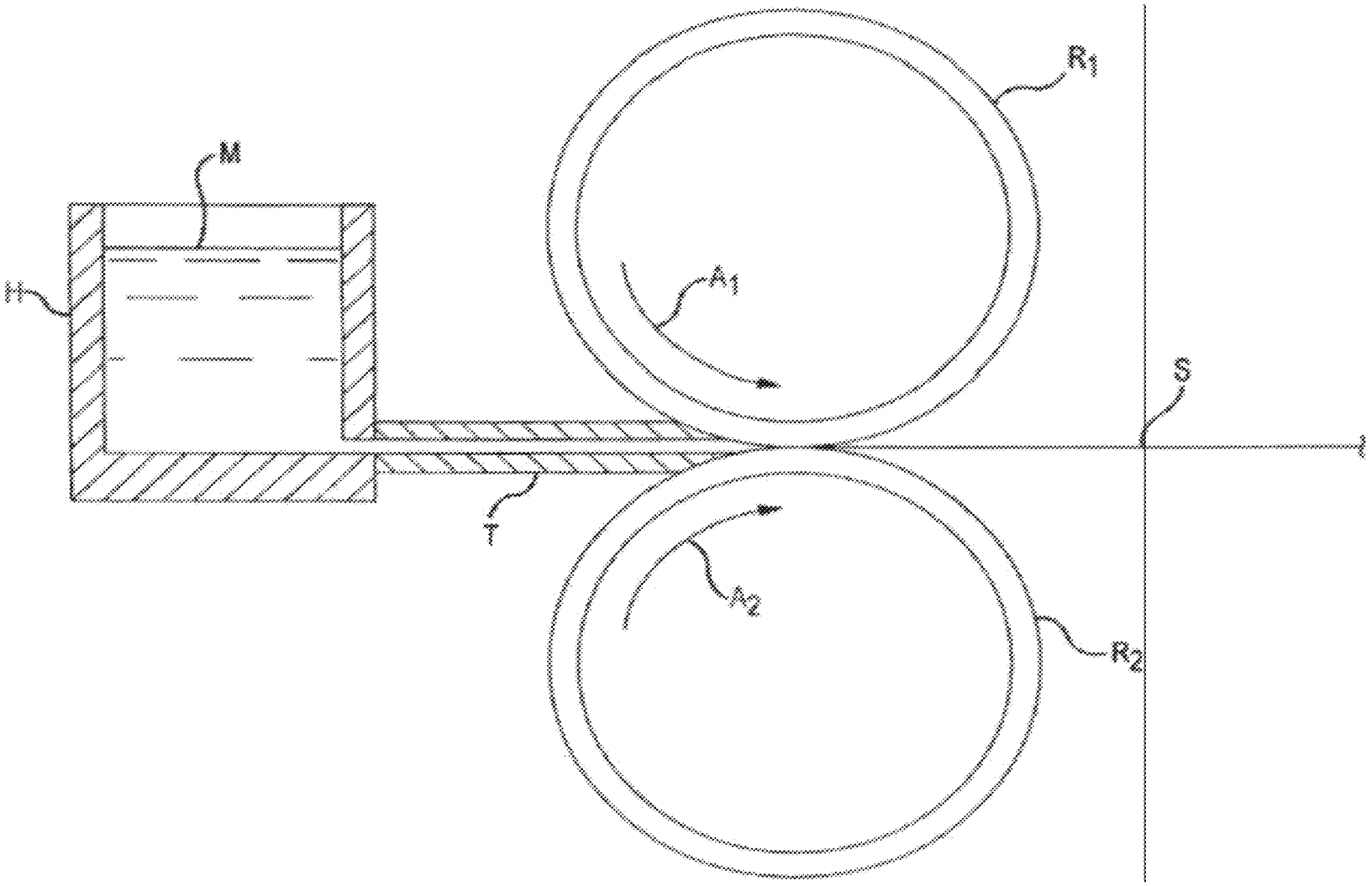
FIG. 10 illustrates features of a continuous casting process.
Figure 11:
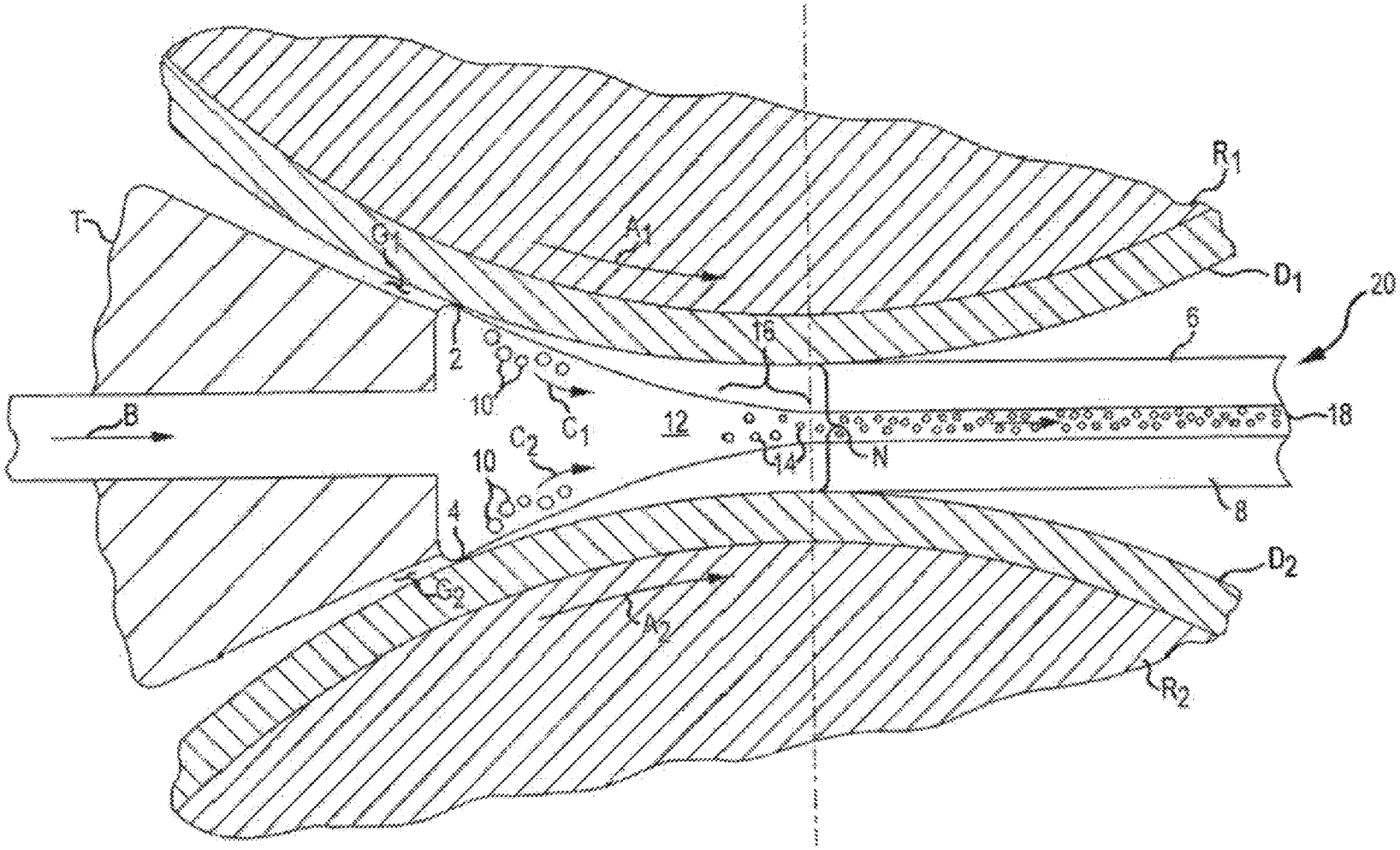
FIG. 11 illustrates features of a continuous casting process.

In other embodiments, to continuously cast, and as illustrated in FIGS. 10-11, a molten aluminum alloy metal M may be stored in a hopper H (or tundish) and delivered through a feed tip T, in a direction B, to a pair of rolls $R_1$ and $R_2$, having respective roll surfaces $D_1$ and $D_2$, which are each rotated in respective directions $A_1$ and $A_2$, to produce a solid cast product S. In an embodiment, gaps $G_1$ and $G_2$ may be maintained between the feed tip T and respective rolls $R_1$ and $R_2$ as small as possible to prevent molten metal from leaking out, and to minimize the exposure of the molten metal to the atmosphere, while maintaining a separation between the feed tip T and rolls $R_1$ and $R_2$. A suitable dimension of the gaps $G_1$ and $G_2$ may be 0.01 inch (0.254 mm). A plane L through the centerline of the rolls $R_1$ and $R_2$ passes through a region of minimum clearance between the rolls $R_1$ and $R_2$ referred to as the roll nip N.

In an embodiment, during the casting step (200), the molten metal M directly contacts the cooled rolls $R_1$ and $R_2$ at regions 2 and 4, respectively. Upon contact with the rolls $R_1$ and $R_2$, the metal M begins to cool and solidify. The cooling metal produces an upper shell 6 of solidified metal adjacent the roll $R_1$ and a lower shell 8 of solidified metal adjacent to the roll $R_2$. The thickness of the shells 6 and 8 increases as the metal M advances towards the nip N. Large dendrites 10 of solidified metal (not shown to scale) may be produced at the interfaces between each of the upper and lower shells 6 and 8 and the molten metal M. The large dendrites 10 may be broken and dragged into a center portion 12 of the slower moving flow of the molten metal M and may be carried in the direction of arrows $C_1$ and $C_2$. The dragging action of the flow can cause the large dendrites 10 to be broken further into smaller dendrites 14 (not shown to scale). In the central portion 12 upstream of the nip N referred to as a region 16, the metal M is semi-solid and may include a solid component (the solidified small dendrites 14) and a molten metal component. The metal M in the region 16 may have a mushy consistency due in part to the dispersion of the small dendrites 14 therein. At the location of the nip N, some of the molten metal may be squeezed backwards in a direction opposite to the arrows $C_1$ and $C_2$. The forward rotation of the rolls $R_1$ and $R_2$ at the nip N advances substantially only the solid portion of the metal (the upper and lower shells 6 and 8 and the small dendrites 14 in the central portion 12) while forcing molten metal in the central portion 12 upstream from the nip N such that the metal may be completely solid as it leaves the point of the nip N. In this manner and in an embodiment, a freeze front of metal may be formed at the nip N. Downstream of the nip N, the central portion 12 may be a solid central portion, 18 containing the small dendrites 14 sandwiched between the upper shell 6 and the lower shell 8. In the central portion, 18, the small dendrites 14 may be 20 microns to 50 microns in size and have a generally globular shape. The three portions, of the upper and lower shells 6 and 8 and the solidified central portion 18, constitute a single, solid cast product (S in FIG. 10 and element 20 in FIG. 11). Thus, the aluminum alloy cast product 20 may include a first portion of an aluminum alloy and a second portion of the aluminum alloy (corresponding to the shells 6 and 8) with an intermediate portion (the solidified central portion 18) therebetween. The solid central portion 18 may constitute 20 percent to 30 percent of the total thickness of the cast product 20.

The rolls $R_1$ and $R_2$ may serve as heat sinks for the heat of the molten metal M. In one embodiment, heat may be transferred from the molten metal M to the rolls $R_1$ and $R_2$ in a uniform manner to ensure uniformity in the surface of the cast product 20. Surfaces $D_1$ and $D_2$ of the respective rolls $R_1$ and $R_2$ may be made from steel or copper and may be textured and may include surface irregularities (not shown) which may contact the molten metal M. The surface irregularities may serve to increase the heat transfer from the surfaces $D_1$ and $D_2$ and, by imposing a controlled degree of non-uniformity in the surfaces $D_1$ and $D_2$, result in uniform heat transfer across the surfaces $D_1$ and $D_2$. The surface irregularities may be in the form of grooves, dimples, knurls or other structures and may be spaced apart in a regular pattern of 20 to 120 surface irregularities per inch, or about 60 irregularities per inch. The surface irregularities may have a height ranging from 5 microns to 50 microns, or alternatively about 30 microns. The rolls $R_1$ and $R_2$ may be coated with a material to enhance separation of the cast product from the rolls $R_1$ and $R_2$ such as chromium or nickel.

The control, maintenance and selection of the appropriate speed of the rolls $R_1$ and $R_2$ may impact the ability to continuously cast products. The roll speed determines the speed that the molten metal M advances towards the nip N. If the speed is too slow, the large dendrites 10 will not experience sufficient forces to become entrained in the central portion 12 and break into the small dendrites 14. In an embodiment, the roll speed may be selected such that a freeze front, or point of complete solidification, of the molten metal M may form at the nip N. Accordingly, the present casting apparatus and methods may be suited for operation at high speeds such as those ranging from 25 to 500 feet per minute; alternatively from 40 to 500 feet per minute; alternatively from 40 to 400 feet per minute; alternatively from 100 to 400 feet per minute; alternatively from 150 to 300 feet per minute; and alternatively 90 to 115 feet per minute. The linear rate per unit area that molten aluminum is delivered to the rolls $R_1$ and $R_2$ may be less than the speed of the rolls $R_1$ and $R_2$ or about one quarter of the roll speed.

Continuous casting of aluminum alloys according to the present disclosure may be achieved by initially selecting the desired dimension of the nip N corresponding to the desired gauge of the cast product S. The speed of the rolls $R_1$ and $R_2$ may be increased to a desired production rate or to a speed which is less than the speed which causes the roll separating force increases to a level which indicates that rolling is occurring between the rolls $R_1$ and $R_2$. Casting at the rates contemplated by the present invention (i.e. 25 to 400 feet per minute) solidifies the aluminum alloy cast product about 1000 times faster than aluminum alloy cast as an ingot cast and improves the properties of the cast product over aluminum alloys cast as an ingot. The rate at which the molten metal is cooled may be selected to achieve rapid solidification of the outer regions of the metal. Indeed, the cooling of the outer regions of metal may occur at a rate of at least 1000 degrees centigrade per second.

The continuous cast strip may be of any suitable thickness, and is generally of sheet gauge (0.006 inch to 0.249 inch) or thin-plate gauge (0.250 inch to 0.400 inch), i.e., has a thickness in the range of from 0.006 inch to 0.400 inch. In one embodiment, the strip has a thickness of at least 0.040 inch. In one embodiment, the strip has a thickness of at not greater than 0.320 inch. In one embodiment, the strip has a thickness of from 0.0070 to 0.018 inches, such as when used for cans or elevated temperature applications.

In one embodiment, the continuous casting is conducted at a sufficient speed so as to result in a cast product having a near surface that is substantially free of large particles having an equivalent diameter of at least 50 micrometers. In one embodiment, the continuous casting is conducted at a sufficient speed so as to result in a cast product having a near surface that is substantially free of large particles having an equivalent diameter of at least 40 micrometers. In one embodiment, the continuous casting is conducted at a sufficient speed so as to result in a cast product having a near surface that is substantially free of large particles having an equivalent diameter of at least 30 micrometers. In one embodiment, the continuous casting is conducted at a sufficient speed so as to result in a cast product having a near surface that is substantially free of large particles having an equivalent diameter of at least 20 micrometers. In one embodiment, the continuous casting is conducted at a sufficient speed so as to result in a cast product having a near surface that is substantially free of large particles having an equivalent diameter of at least 10 micrometers. In one embodiment, the continuous casting is conducted at a sufficient speed so as to result in a cast product having a near surface that is substantially free of large particles having an equivalent diameter of at least 3 micrometers.

In some embodiments, the continuous casting step (200) includes delivering (210) the hypereutectic aluminum alloy to a pair of rolls at a speed, where the rolls are configured to form a nip and wherein the speed ranges from 50 to 300 feet per minute, solidifying (220) the hypereutectic aluminum alloy to produce solid outer portions adjacent to each roll and a semi-solid central portion between the solid outer portions; and solidifying (230) the central portion within the nip to form a cast product.

In some embodiments, the casting speed is selected so as to result in a particle count per unit area and/or volume fraction as described herein. In some embodiments, the casting speed is selected so as to result in a particle count per unit area and/or volume fraction as shown in FIGS. 3 and 4, respectively.

B. Rolling and/or Batch Annealing

In some embodiments, the cast product is hot rolled, cold rolled, and/or batch annealing sufficiently to form an aluminum alloy strip as described herein.

Once the continuously cast product is removed from the casting apparatus, i.e., after the continuously casting step (200), the continuously cast product may be hot rolled (310), such as to final gauge or an intermediate gauge. The hot rolling step (310), may reduce the thickness of the cast product anywhere from 1-2% to 90%, or more. In this regard, the aluminum alloy cast product may exit the casting apparatus at a temperature below the alloy solidus temperature, which is alloy dependent, and generally in the range of from 900° F. to 1150° F.

In this embodiment, after the hot rolling step (310), the hot rolled product may be cold rolled (320), such as to final gauge or intermediate gauge. The cold rolling step (320), may reduce the thickness of the hot rolled product anywhere from 1-2% to 90%, or more.

In this embodiment, after the cold rolling step (320), the cold rolled product may be annealed (330). In some embodiments, the cold rolled product may be batch annealed. In some embodiments, the batch anneal step may be conducted at any suitable temperature and duration so as to result in a product capable of use for can making and/or elevated temperature applications. In an embodiment, the anneal and/or batch anneal is conducted at a temperature in the range of 500° F. to 1200° F. for 1 to 10 hours. As used herein, the "temperature" of the anneal or batch anneal corresponds to the metal soak temperature. In an embodiment, the anneal and/or batch anneal is conducted at a temperature in the range of 600° F. to 1100° F. for 1 to 5 hours. In an embodiment, the anneal and/or batch anneal is conducted at a temperature in the range of 700° F. to 1000° F. for 2 to 4 hours. In an embodiment, the anneal and/or batch anneal is conducted at a temperature of 850° F. for 3 hours. In an embodiment, the anneal and/or batch anneal is conducted at a temperature of 875° F. for 4 hours.

In this embodiment, after the batch anneal step (310), the batch annealed product may be cold rolled (340), such as to final gauge or intermediate gauge, to form an aluminum alloy strip as described herein. The cold rolling step (340), may reduce the thickness of the batch annealed product anywhere from 1-2% to 90%, or more.

C. Processing to Form Products for can Making Applications

In an embodiment, after the cold rolling step (340), the aluminum alloy strip may be subjected to additional processing (400) to form a product configured for can making applications. In an embodiment, the product may include a can body or can end. In an embodiment, the processing (400) may include a cupping (410) and/or ironing (420) to form a can body. In an embodiment, cupping includes a drawing process used to form a cylindrical or similarly shaped product. In yet another embodiment, the cupped product may be subjected to an ironing (420) step. In some embodiments, the ironing (420) may be conducted using one or more dies positioned on the exterior of the cupped product to thin the wall and increase the height of the cupped product. In some embodiments, the ironing step (420) results in a can body.

In some embodiments, processing steps include one or a combination of the following: drawing, drawing and ironing, draw reverse draw, drawing and stretching, deep drawing, 3-piece seaming, curling, flanging, threading, and seaming. In some embodiments, processing steps include shaping the can. Shaping includes narrowing and/or expanding the diameter of the can using any appropriate shaping method.

Narrowing can be done by any method known in the art, including but not limited to die necking and spin forming. Necking or spin forming can be performed in any way known in the art, including as described in U.S. Pat. Nos. 4,512,172; 4,563,887; 4,774,839; 5,355,710 and 7,726,165. Expanding the can be accomplished by any method known in the art, including but not limited to inserting the working surface of an expansion die into an open end of the container. Expanding using an expansion die can be performed any way known in the art, including as described in U.S. Pat. Nos. 7,934,410 and 7,954,354. In some embodiments, any appropriate method of forming the can to accept a closure may be used including: forming a flange, curling, threading, forming a lung, attaching an outsert and hem, or combinations thereof.

D. Photomicrograph Procedure

Photomicrographs are obtained using a FEI Sirion Field Emission Gun Scanning Electron Microscope (hereinafter "SEM").

A metallographic cross section in the rolling direction of the sample is first prepared using any standard metallographic method. An example of a standard metallographic method is described in the Pack Mount Examination Preparation Procedure.

The SEM is then set to collect backscattered electrons for gray level 8 bit digital image captures at a magnification of 2500× with a pixel resolution of 1296×968 in a square array with a scan rate of 66.4 milliseconds per line.

The accelerating voltage on the SEM is set to 10 kV, the condenser lens is set to a spot size of 3, and the working distance is set to 3 millimeters.

The field of view of the SEM is then adjusted to view the near surface of the sample. In an embodiment, the top of the field of view is at the sample surface (T) and the bottom of the field of view is at about 37 micrometers below the sample surface (T/7).

The SEM contrast is then set to 99.0 and the SEM brightness is set to 76.5.

The SEM is then used to obtain a photomicrograph and determine the average gray level of the aluminum matrix with a certain standard deviation shown in the photomicrograph.

Photomicrograph Example

Figure 12:
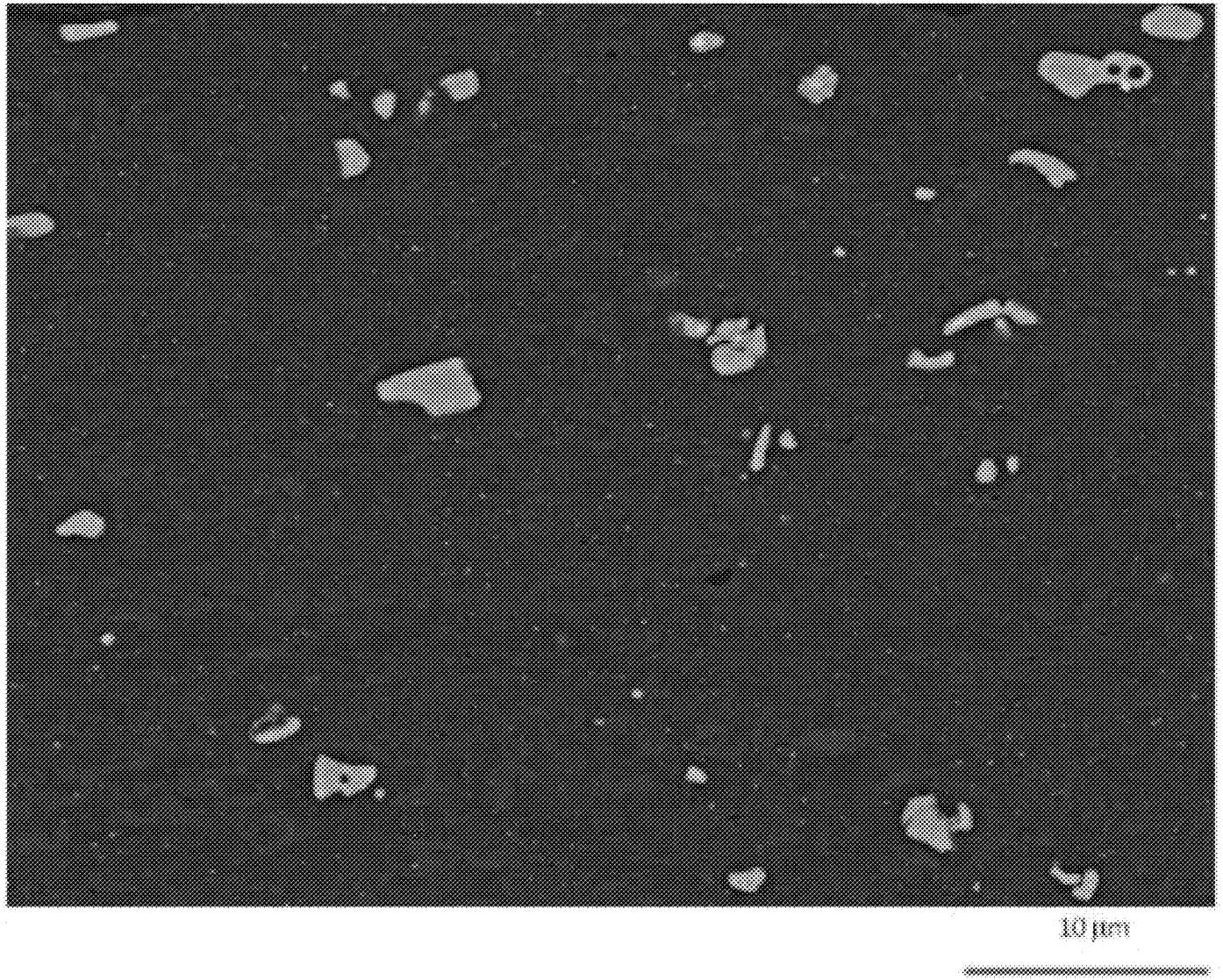
FIG. 12 is a photomicrograph showing features of an ingot.
Figure 13:
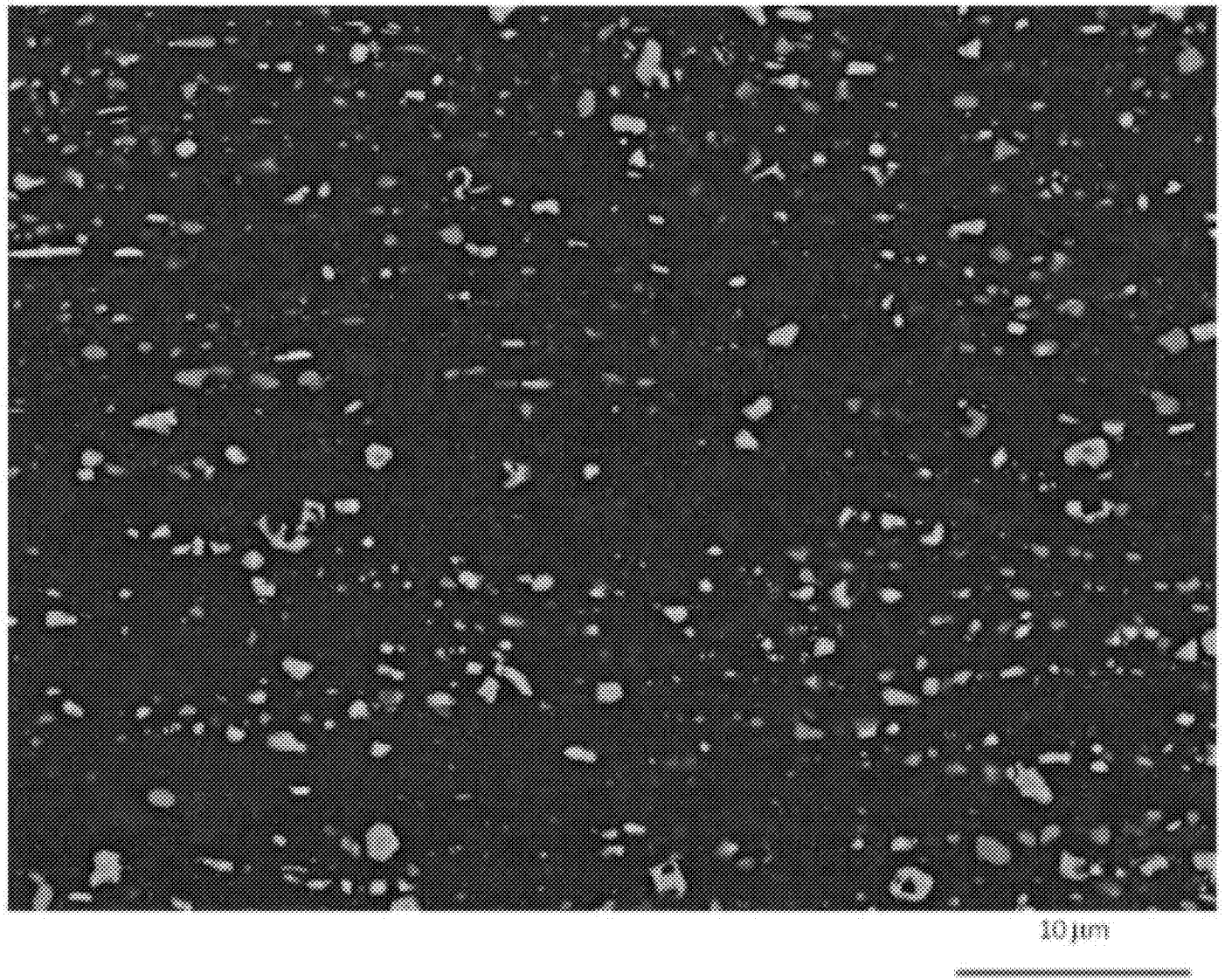
FIG. 13 is a photomicrograph showing features of some embodiments of the present invention.

In one example, the SEM is used to obtain a photomicrograph with an average gray level of the aluminum matrix of about 45 with a standard deviation of about 10. Non-limiting examples of photomicrographs obtained using the Photomicrograph Procedure are shown in FIG. 12 (ingot) and FIG. 13 (product cast according to the methods described herein).

E. Photomicrograph Analysis Procedure

The photomicrograph(s) obtained using the Photomicrograph Procedure are then analyzed using Carl Zeiss KS400 software and the procedure detailed below.

A gray level threshold of a potential particle pixel is selected as the sum of the aluminum matrix average gray level of the photomicrograph and 5 times the standard deviation of the aluminum matrix average gray level of the photomicrograph.

A binary image having two gray levels—0-black and 255-white—is then generated from the photomicrograph.

Groups of less than 25 adjoining pixels are then removed from the binary image. The resultant image after removal of the groups of less than 25 adjoining pixels is a "particle binary image." "Particle pixels", as used herein, are adjoining pixels in groups of at least 25 in any of the 8 possible directions on a square array of a binary image. Groups of less than the 25 adjoining pixels are not associated with particles (i.e., are not particle pixels) and are thus removed from the binary image during this step. At 2500× magnification, a pixel has a size of 0.0395257 micrometers in the x-direction and 0.038759 micrometers in the y-direction corresponding to an individual pixel area of about 0.001532 square micrometers. Thus, since "particle pixels" are defined as groups of at least 25 adjoining pixels, the minimum area of a particle is 0.0383 square micrometers corresponding to a minimum equivalent diameter of 0.22 micrometers.

The area fraction/volume fractions of the particles are then calculated based on the particle binary image. As used herein, area fractions and volume fractions of the particles are equal. See Ervin E. Underwood, Quantitative Stereology 27 (Addison-Wesley Pub. Co. 1970). The area fraction/volume fraction is calculated as the quantity of the pixels in the particle binary image at a gray scale of 255 divided by the number of pixels in a frame (1,296×968 or 1,254,528) multiplied by 100 or (quantity of pixels at a gray scale of 255)/(number of pixels in a frame or 1,254,528)×100.

The particle count is then calculated based on the particle binary image. First, each individual particle in particle binary image is identified based on pixels at a gray scale of 255 that are adjoining in any of the 8 directions on a square array. Then, the particle count is calculated based on the number of individual particles identified in the particle binary image.

The area of each of the particles is then calculated based on the particle binary image. The area of each particle is calculated by summing the number of adjoining particle pixels and multiplying by the area of each pixel or about 0.001532 square micrometers at 2500× magnification. Individual particles that contact the side of the particle binary image are excluded such that only whole particles are measured. Each particle area is then included in a "bin" that corresponds to a specific particle area range.

This process is then repeated for forty photomicrographs collected at near surface.

The particle count per unit area is then calculated as (the particle count) divided by [(the number of pixels in a frame (1,296×968 or 1,254,528)×the area of each pixel (0.001532 square micrometers at 2500× magnification)×the number of photomicrographs analyzed (40) which equals about 76,600 square micrometers)].

Photomicrograph Analysis Example

In one example, the gray level threshold of a potential particle pixel is 95—i.e., the sum of the aluminum matrix gray level of 45 and 5 times the standard deviation of 10 (50).

Figure 14:
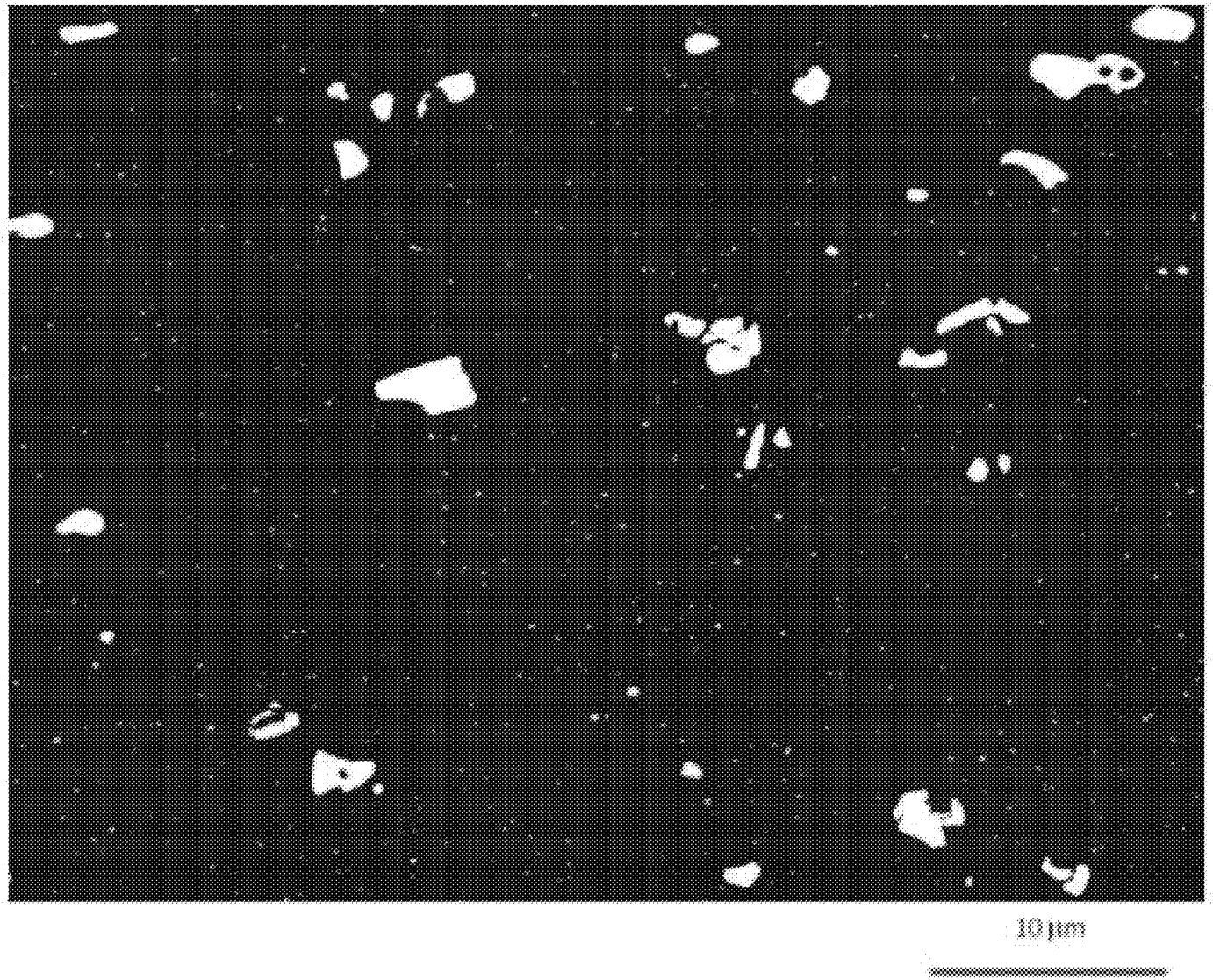
FIG. 14 is a binary image of the photomicrograph of FIG. 12.
Figure 15:
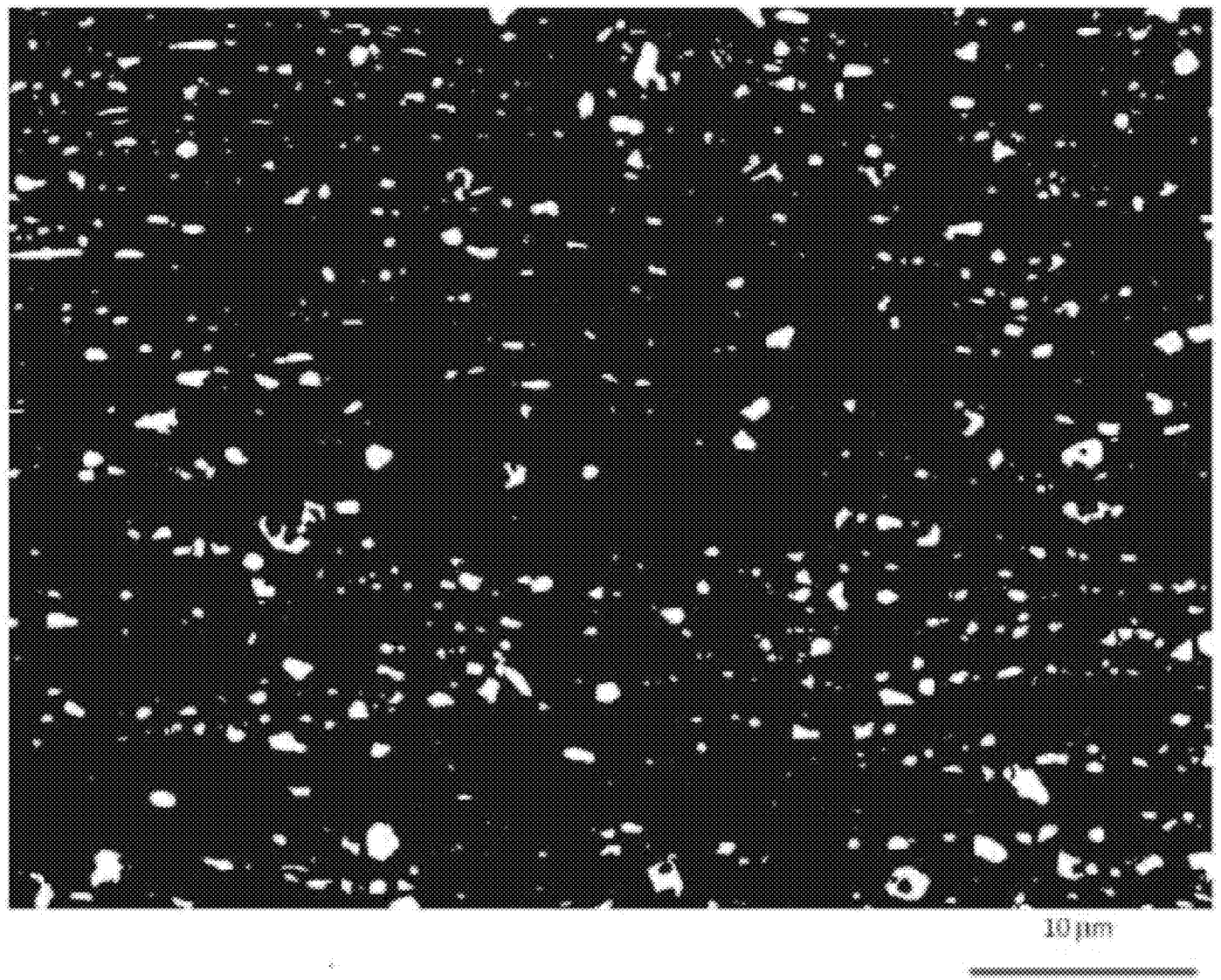
FIG. 15 is a binary image of the photomicrograph of FIG. 13.

Non-limiting examples of the binary images generated as detailed in the Photomicrograph Analysis Procedure described herein are shown in FIGS. 14 and 15. FIG. 14 shows a binary image generated from the photomicrograph of the ingot shown in FIG. 12. FIG. 15 shows a binary image of the photomicrograph of the product cast according to the methods described herein shown in FIG. 13.

Figure 16:
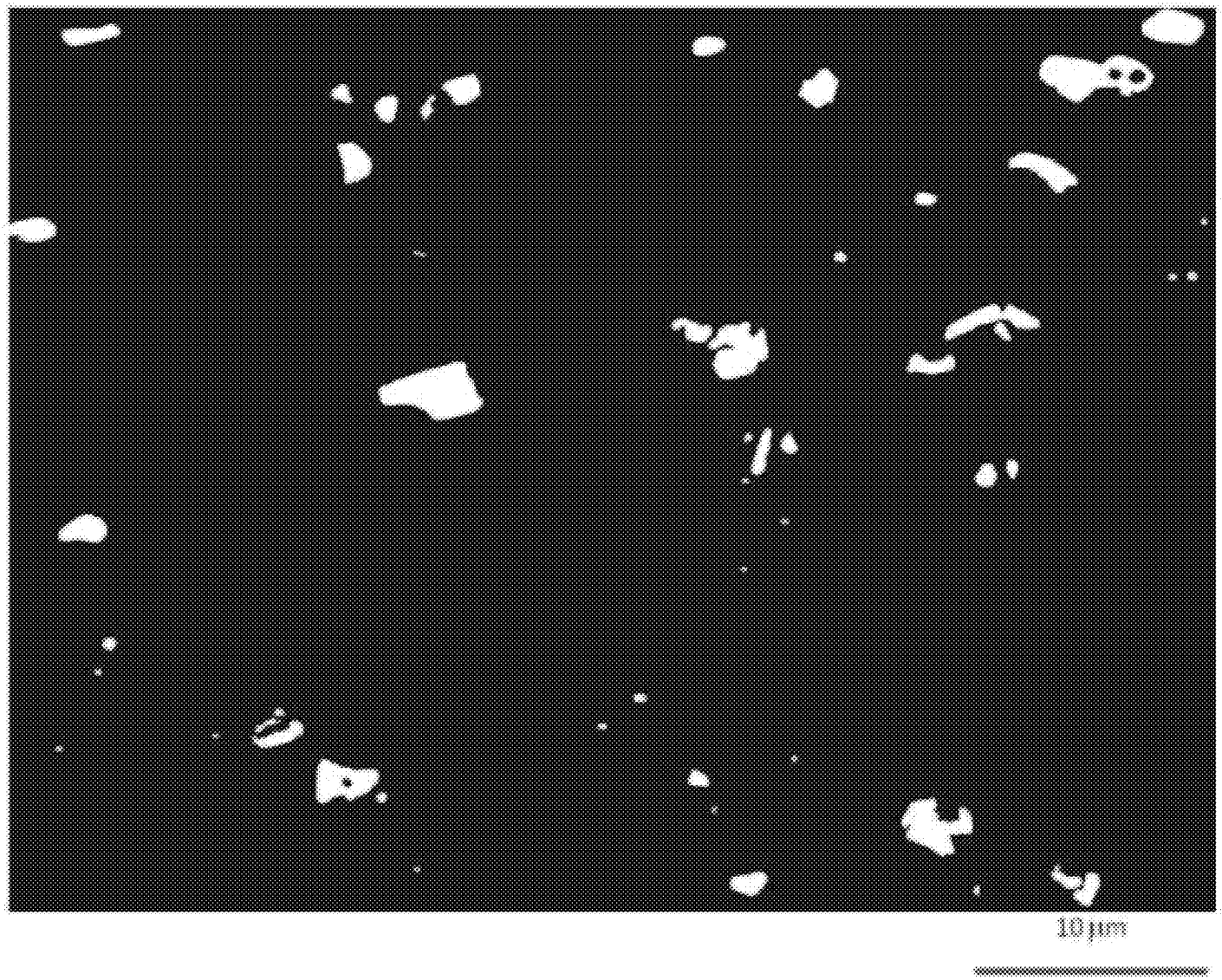
FIG. 16 is the binary image of the FIG. 14 after removal of the non-particle pixels.
Figure 17:
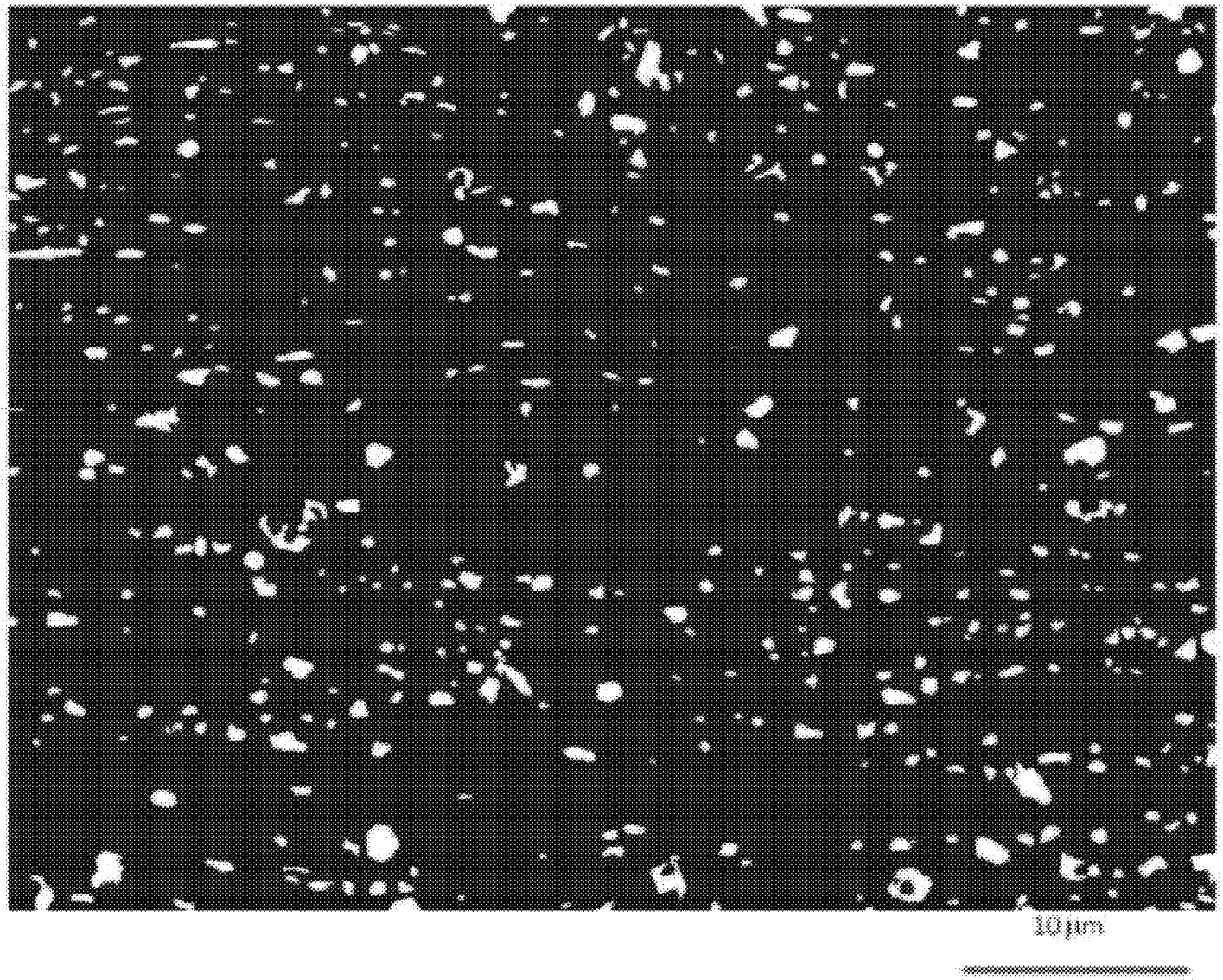
FIG. 17 is the binary image of FIG. 15 after removal of the non-particle pixels.

Non-limiting examples of the particle binary images after removal of the non-particle pixels as detailed in the Photomicrograph Analysis Procedure described herein are shown in FIGS. 16 and 17. FIG. 16 was generated by removing the non-particle pixels of the binary image of the ingot shown in FIG. 12. FIG. 17 was generated by removing the non-particle pixels of the binary image of the product cast according to the methods described herein shown in FIG. 13.

F. Pack Mount Examination Preparation Procedure

The following is a non-limiting example of a procedure for preparing a sample for the Photomicrograph Procedure.

Pack mounts are used to assemble several samples together in a manner that prevents samples from deforming during mounting and permits conductivity, if necessary. To maintain rigidity during mounting, binders and screws are used to bundle the samples. Separators are used to separate the individual samples. AA3104 (typically approximately 0.38 inches thick) material may be used as binders, high purity foil as separators and non-magnetic steel screws and nuts. Samples and separators are sandwiched between four binders (two on the front, two on the back) and held by screws.

Figure 18:
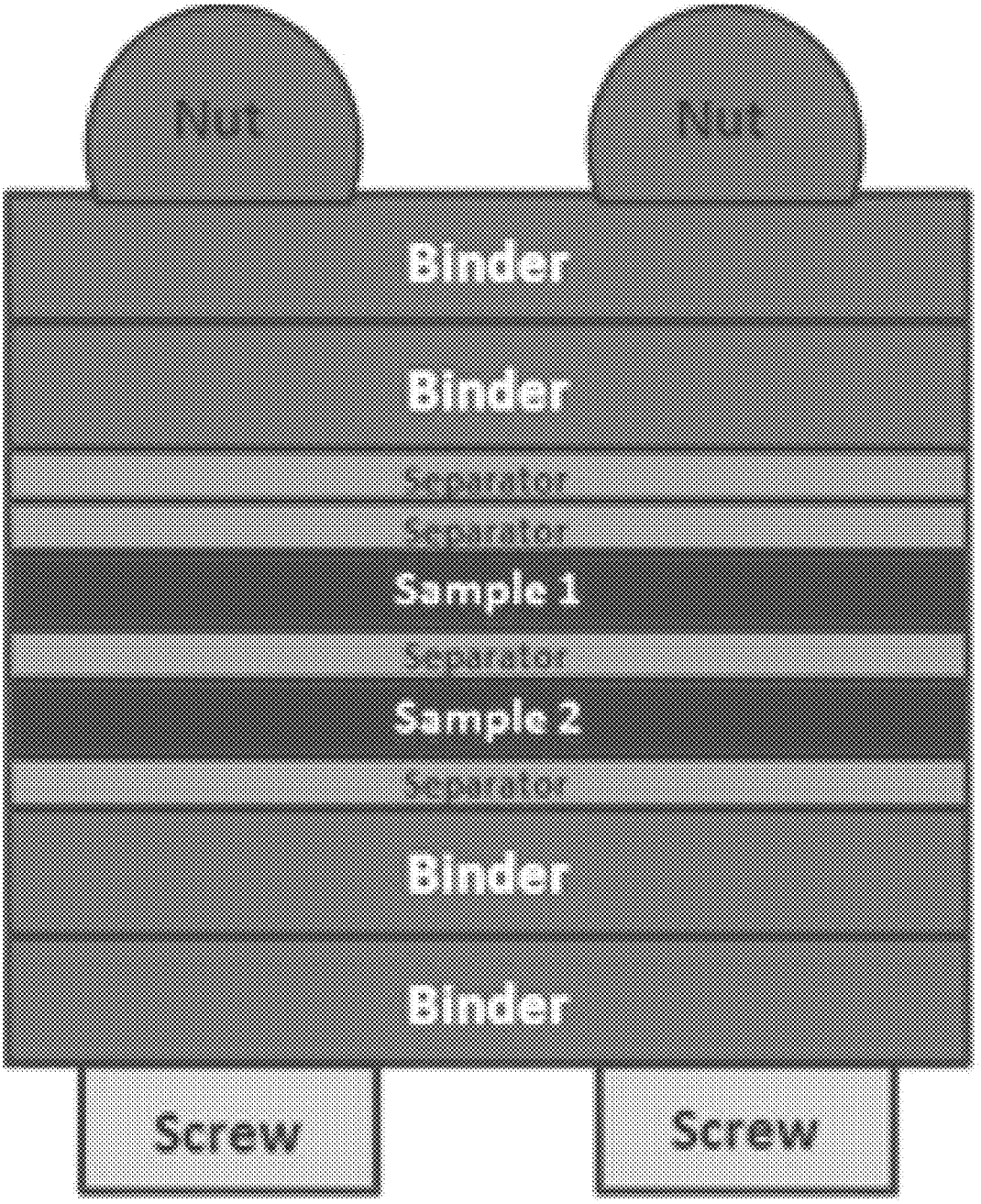
FIG. 18 illustrates a non-limiting example of a pack mount used for sample preparation.

To maintain sample identification, the head of the screw is used to signify the first sample. The order from the front of the mount is: two binders, two separators, sample 1, separator, sample 2, separator, . . . sample n, separator, two binders; where n is the total number of samples. FIG. 18 shows a non-limiting example of a pack mount detailed above.

To create a pack mount as detailed in FIG. 18, pack the samples and the binders as shown in FIG. 18 and position the pack into a vise or equivalent. Two screws are used to bind the samples as shown in FIG. 18. Drill two aptly placed and sized holes (depends on size of screws/nuts) into the pack. De-bur the holes before tightening the nuts. Cut the back of the screws so that they are flush with the nuts. Smooth any rough surfaces. Trim the pack to suitable size for mounting. Also, grind and sharpen corners/edges before mounting.

The pack can then be mounted by any suitable method. For example, the pack may be mounted with clear Lucite and/or conductive powders in an appropriate mounting press that applies heat and pressure to consolidate the powders. The mounting presses may be pre-programmed for pressure, and the heating and cooling cycles. For delicate or thin samples, the automatic programs may be disengaged to allow for manual reduction of the pressures. Alternatively, for delicate samples, or where improved sample edge retention is desired, two-part epoxy compounds may be used for mounting the samples. The samples may then be labeled with an appropriate identifier.

The mounted samples may then be mounted into a grinding/polishing carousel, ensuring that all cavities in the carousel are filled with either samples or dummies, and metallographically ground and polished pursuant to ASTM E3 (2011). Grinding and polishing are conducted using a Struers Abropol-2, a Buehler Ecomet/Automet 300, or equivalent device. Grinding typically starts with 240 grit paper, followed by finer grit papers of 320, 400, and 600 grade. Grinding time in each step is typically about 30 seconds. Pressure is applied typically in the range of 15 Newtons to 30 Newtons per sample. The lower end of the pressure range is most suited to the preparation of aluminum alloy samples. After each grinding step, the sample is cleaned under running cold water, the water is removed using pressurized air, and the sample is visually examined. If any evidence of specimen cutting or the previous grinding step is observed, the step is repeated until an acceptable finish is achieved.

The sample is then polished again using the Struers Abropol-2, the Buehler Ecomet/Automet 300, or equivalent. The polishing steps are typically conducted for about 2 minutes each, with pressure in the range of 20 Newtons to 25 Newtons per sample, and are detailed below:

(i) Mol cloth with 3 micron diamond spray with DP-Lubricant Red (ii) Silk cloth with 3 micron diamond spray with Microid diamond extender (iii) Mol cloth with 1 micron spray with DP-Lubricant Red (iv) Silk cloth with 1 micron diamond spray with Microid diamond extender (v) Final step is OPS diluted down to a 50:50 mixture with deionized water, used on a Technotron cloth for 30 seconds.

Between each step, the samples are cleaned by swabbing with a cotton wool ball dipped in a mixture of liquid soap and water, rinsing clean under cold running water, then removing the water using pressurized air.

After the final polishing step, the sample(s) may be used in the Photomicrograph Procedure detailed above.

NON-LIMITING EXAMPLES

Aluminum alloys having the composition in Table 1, below, and processed in accordance with the methods described herein are used in non-limiting Examples 1 and 2.

TABLE 1

Composition of Aluminum Alloys used in Examples 1 and 2 (in wt. %)

| Sample | Si | Fe | Cu | Mn | Mg |
|---|---|---|---|---|---|
| 12 | 0.29 | 0.74 | 0.64 | 1.12 | 0.85 |
| 13 | 0.3 | 0.72 | 0.19 | 1.1 | 1.58 |
| 14 | 0.67 | 0.68 | 0.2 | 1.1 | 0.77 |
| 16 | 0.66 | 0.68 | 0.59 | 1.03 | 1.53 |
| 240 | 0.23 | 1.73 | 0.49 | 1.23 | 1.39 |
| 241 | 0.25 | 1.15 | 0.23 | 1.77 | 1.39 |
| 242 | 0.27 | 0.59 | 0.35 | 2.12 | 1.45 |
| 243 | 0.26 | 1.01 | 0.34 | 1.21 | 1.39 |
| 265 | 0.26 | 0.6 | 0.2 | 0.94 | 1.41 |
| 266 | 0.24 | 0.75 | 0.2 | 1.08 | 1.36 |
| 267 | 0.25 | 1.46 | 0.21 | 0.86 | 1.41 |
| 268 | 0.25 | 1.99 | 0.21 | 0.94 | 1.37 |
| 269 | 0.49 | 1.95 | 0.21 | 0.93 | 1.4 |
| 270 | 0.24 | 1.44 | 0.21 | 1.97 | 1.36 |
| 271 | 0.35 | 1.96 | 0.2 | 0.92 | 1.38 |
| Ingot* | 0.22 | 0.53 | 0.18 | 0.91 | 1.18 |
| 2219-T87* | 0.2 (max) | 0.3 (max) | 5.8-6.8 | 0.2-0.4 | 0.02 (max) |

*The Ingot and 2219-T87 are reference materials and were processed as detailed in each example. 2219-T87 also includes 0.02 wt. % to 0.10 wt. % titanium, 0.05 wt. % to 0.15 wt. % vanadium, 0.10 wt. % to 0.25 wt. % zirconium, 0.10 wt. % (max) zinc, and not greater than 0.05 wt. % of any other element, with the total of the other elements not exceeding 0.15 wt. % in the aluminum alloy.

The aluminum alloys contained not greater than 0.10 wt. % Zn, not greater than 0.05 wt. % oxygen, and not greater than 0.05 wt. % of any other element, with the total of the other elements not exceeding 0.15 wt. % in the aluminum alloy.

A. Example 1

The aluminum alloys of Example 1 include samples 12, 13, 14, 16, 240, 241, 242, 243 and Ingot. Samples 12, 13, 14, 16, 240, 241, 242, and 243 were first heated in a furnace at a temperature ranging from 1335° F. to 1435° F. The molten metal was cast at about 0.105 inches at a speed of 90 to 115 feet per minute using the process described herein. The cast product was then hot rolled to 0.070 inches. The hot rolled product was then cold rolled to 0.020 inches and subjected to a batch anneal at 850° F. for 3 hours. The batch annealed product was then cold rolled to a final gauge of 0.0108 inches.

The Ingot sample was fully annealed at 850° F. for 3 hours at 0.095 inches and then cold rolled to 0.0108 inches.

Photomicrographs were generated from the samples 12, 13, 14, 16, 240, 241, 242, 243 and Ingot using the Photomicrograph Procedure and analyzed using the Photomicrograph Analysis Procedure detailed above. All micrographs were taken at the same magnification.

Figure 2:
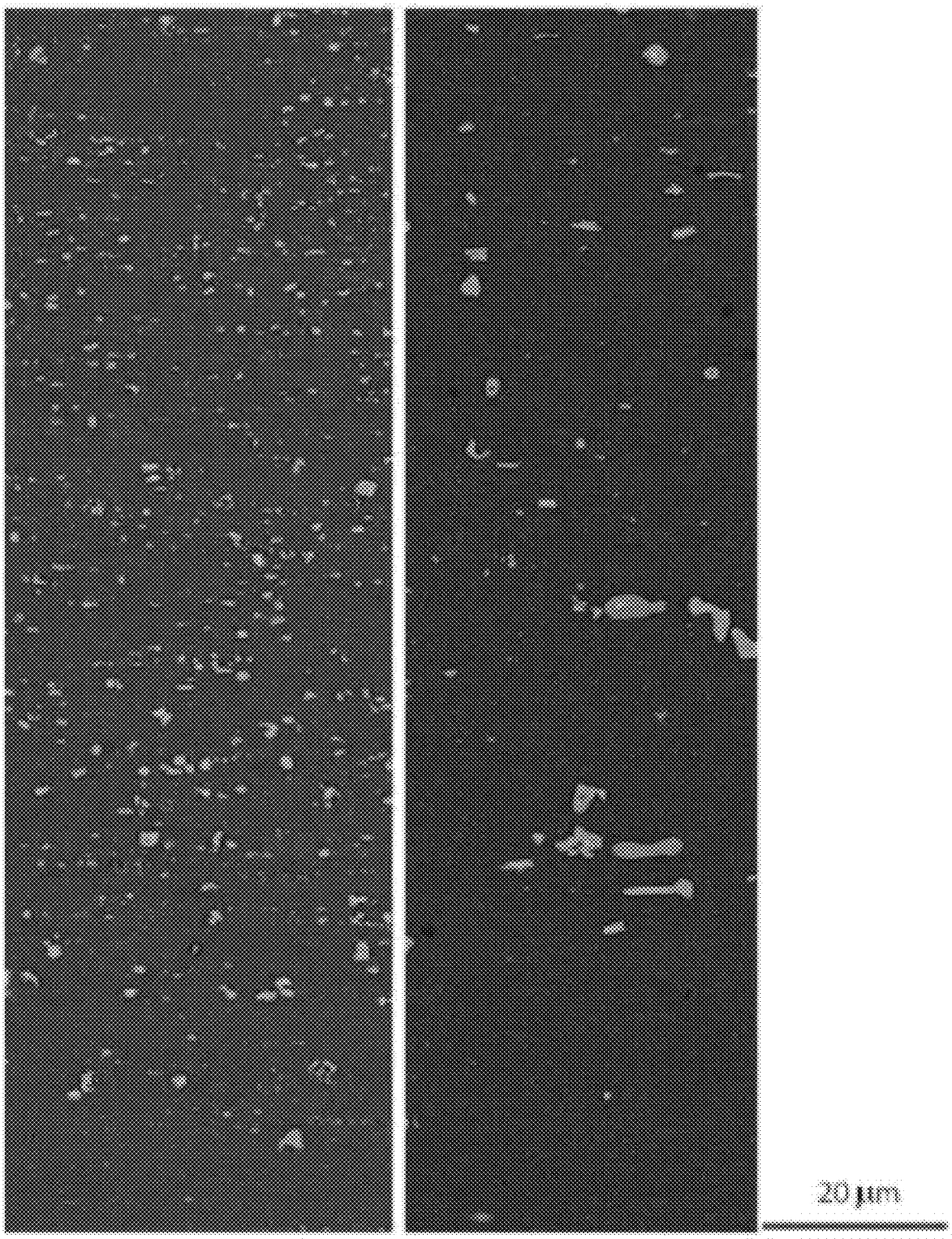
FIG. 2 is a magnified view of portions of FIG. 1.

The photomicrographs of the samples of Example 1 are shown in FIG. 1. FIG. 2 shows a magnified view of the photomicrographs of sample 243 and the Ingot sample. As shown in FIGS. 1 and 2, the particle areas of samples 12, 13, 14, 16, 240, 241, 242, and 243 are smaller than the particle areas of the Ingot sample. Further, the particles per unit area in samples 12, 13, 14, 16, 240, 241, 242, and 243 are larger than the particles per unit area in the Ingot sample. Moreover, the volume fraction of the particles in samples 12, 13, 14, 16, 240, 241, 242, and 243 are larger than the volume fraction of the particles in the Ingot sample.

The results of the photomicrograph analysis of samples 12, 13, 14, 16, 240, 241, 242, 243 and Ingot are shown in the following tables:

TABLE 2

Photomicrograph Analysis of Sample 12

| Sample | Bin | Particle Count | Particle Count Per Unit Area (Particle Count/Square Micrometer) | Volume Fraction (%) | Average Area (Micrometer)* | Equivalent Diameter (Micrometer) |
|---|---|---|---|---|---|---|
| 12 | 1 | 6 | 7.83E−05 | 0.014 | 1.733 | 1.485 |
| 12 | 2 | 50 | 6.53E−04 | 0.080 | 1.235 | 1.254 |
| 12 | 3 | 227 | 2.96E−03 | 0.225 | 0.762 | 0.985 |
| 12 | 4 | 603 | 7.87E−03 | 0.380 | 0.485 | 0.785 |
| 12 | 5 | 1285 | 1.68E−02 | 0.519 | 0.310 | 0.629 |
| 12 | 6 | 2053 | 2.68E−02 | 0.530 | 0.199 | 0.503 |
| 12 | 7 | 2828 | 3.69E−02 | 0.464 | 0.126 | 0.401 |
| 12 | 8 | 3097 | 4.04E−02 | 0.323 | 0.080 | 0.320 |
| 12 | 9 | 3238 | 4.23E−02 | 0.213 | 0.051 | 0.254 |

*Average area is equal to the sum of the measured areas of the particles in the bin divided by the number of particles in the bin.

TABLE 3

Photomicrograph Analysis of Sample 13

| Sample | Bin | Particle Count | Particle Count Per Unit Area (Particle Count/Square Micrometer) | Volume Fraction (%) | Average Area (Micrometer)* | Equivalent Diameter (Micrometer) |
|---|---|---|---|---|---|---|
| 13 | 1 | 1 | 1.31E−05 | 0.004 | 2.967 | 1.944 |
| 13 | 2 | 19 | 2.48E−04 | 0.046 | 1.843 | 1.532 |
| 13 | 3 | 101 | 1.32E−03 | 0.161 | 1.227 | 1.250 |
| 13 | 4 | 344 | 4.49E−03 | 0.341 | 0.762 | 0.985 |
| 13 | 5 | 785 | 1.02E−02 | 0.497 | 0.487 | 0.787 |
| 13 | 6 | 1316 | 1.72E−02 | 0.536 | 0.313 | 0.631 |
| 13 | 7 | 1755 | 2.29E−02 | 0.454 | 0.199 | 0.503 |
| 13 | 8 | 2105 | 2.75E−02 | 0.346 | 0.127 | 0.401 |
| 13 | 9 | 2135 | 2.79E−02 | 0.224 | 0.081 | 0.320 |
| 13 | 10 | 1964 | 2.56E−02 | 0.130 | 0.051 | 0.254 |

*Average area is equal to the sum of the measured areas of the particles in the bin divided by the number of particles in the bin.

TABLE 4

Photomicrograph Analysis of Sample 14

| Sample | Bin | Particle Count | Particle Count Per Unit Area (Particle Count/Square Micrometer) | Volume Fraction (%) | Average Area (Micrometer)* | Equivalent Diameter (Micrometer) |
|---|---|---|---|---|---|---|
| 14 | 1 | 1 | 1.31E−05 | 0.004 | 3.020 | 1.961 |
| 14 | 2 | 8 | 1.04E−04 | 0.019 | 1.819 | 1.522 |
| 14 | 3 | 56 | 7.31E−04 | 0.085 | 1.171 | 1.221 |
| 14 | 4 | 251 | 3.28E−03 | 0.251 | 0.768 | 0.989 |
| 14 | 5 | 683 | 8.92E−03 | 0.434 | 0.488 | 0.788 |
| 14 | 6 | 1428 | 1.86E−02 | 0.576 | 0.310 | 0.629 |
| 14 | 7 | 2325 | 3.04E−02 | 0.603 | 0.199 | 0.504 |
| 14 | 8 | 2911 | 3.80E−02 | 0.482 | 0.127 | 0.403 |
| 14 | 9 | 2929 | 3.82E−02 | 0.308 | 0.081 | 0.321 |
| 14 | 10 | 2764 | 3.61E−02 | 0.183 | 0.051 | 0.255 |

*Average area is equal to the sum of the measured areas of the particles in the bin divided by the number of particles in the bin.

TABLE 5

Photomicrograph Analysis of Sample 16

| Sample | Bin | Particle Count | Particle Count Per Unit Area (Particle Count/Square Micrometer) | Volume Fraction (%) | Average Area (Micrometer)* | Equivalent Diameter (Micrometer) |
|---|---|---|---|---|---|---|
| 16 | 1 | 4 | 5.22E−05 | 0.014 | 2.661 | 1.841 |
| 16 | 2 | 31 | 4.05E−04 | 0.074 | 1.829 | 1.526 |
| 16 | 3 | 155 | 2.02E−03 | 0.246 | 1.222 | 1.247 |
| 16 | 4 | 450 | 5.87E−03 | 0.453 | 0.775 | 0.993 |
| 16 | 5 | 982 | 1.28E−02 | 0.632 | 0.495 | 0.794 |
| 16 | 6 | 1484 | 1.94E−02 | 0.605 | 0.314 | 0.632 |
| 16 | 7 | 1613 | 2.11E−02 | 0.422 | 0.201 | 0.506 |
| 16 | 8 | 1749 | 2.28E−02 | 0.288 | 0.127 | 0.402 |
| 16 | 9 | 1540 | 2.01E−02 | 0.162 | 0.081 | 0.321 |
| 16 | 10 | 1360 | 1.78E−02 | 0.090 | 0.051 | 0.255 |

*Average area is equal to the sum of the measured areas of the particles in the bin divided by the number of particles in the bin.

TABLE 6

Photomicrograph Analysis of Sample 240

| Sample | Bin | Particle Count | Particle Count Per Unit Area (Particle Count/Square Micrometer) | Volume Fraction (%) | Average Area (Micrometer)* | Equivalent Diameter (Micrometer) |
|---|---|---|---|---|---|---|
| 240 | 1 | 1 | 1.31E−05 | 0.006 | 4.265 | 2.330 |
| 240 | 2 | 12 | 1.57E−04 | 0.047 | 3.037 | 1.967 |
| 240 | 3 | 97 | 1.27E−03 | 0.238 | 1.886 | 1.550 |
| 240 | 4 | 340 | 4.44E−03 | 0.534 | 1.208 | 1.240 |
| 240 | 5 | 875 | 1.14E−02 | 0.895 | 0.786 | 1.000 |
| 240 | 6 | 1622 | 2.12E−02 | 1.048 | 0.497 | 0.795 |
| 240 | 7 | 2378 | 3.10E−02 | 0.973 | 0.314 | 0.633 |
| 240 | 8 | 3305 | 4.31E−02 | 0.855 | 0.199 | 0.503 |
| 240 | 9 | 3685 | 4.81E−02 | 0.609 | 0.127 | 0.402 |
| 240 | 10 | 3893 | 5.08E−02 | 0.408 | 0.081 | 0.320 |
| 240 | 11 | 3968 | 5.18E−02 | 0.260 | 0.050 | 0.253 |

*Average area is equal to the sum of the measured areas of the particles in the bin divided by the number of particles in the bin.

TABLE 7

Photomicrograph Analysis of Sample 241

| Sample | Bin | Particle Count | Particle Count Per Unit Area (Particle Count/Square Micrometer) | Volume Fraction (%) | Average Area (Micrometer)* | Equivalent Diameter (Micrometer) |
|---|---|---|---|---|---|---|
| 241 | 1 | 2 | 2.61E−05 | 0.012 | 4.762 | 2.462 |
| 241 | 2 | 16 | 2.09E−04 | 0.064 | 3.086 | 1.982 |
| 241 | 3 | 48 | 6.27E−04 | 0.118 | 1.890 | 1.551 |
| 241 | 4 | 196 | 2.56E−03 | 0.304 | 1.192 | 1.232 |
| 241 | 5 | 601 | 7.85E−03 | 0.602 | 0.770 | 0.990 |
| 241 | 6 | 1402 | 1.83E−02 | 0.897 | 0.492 | 0.792 |
| 241 | 7 | 2369 | 3.09E−02 | 0.967 | 0.314 | 0.632 |
| 241 | 8 | 3214 | 4.20E−02 | 0.837 | 0.200 | 0.505 |
| 241 | 9 | 3591 | 4.69E−02 | 0.594 | 0.127 | 0.402 |
| 241 | 10 | 3613 | 4.72E−02 | 0.378 | 0.081 | 0.320 |
| 241 | 11 | 3561 | 4.65E−02 | 0.234 | 0.050 | 0.253 |

*Average area is equal to the sum of the measured areas of the particles in the bin divided by the number of particles in the bin.

TABLE 8

Photomicrograph Analysis of Sample 242

| Sample | Bin | Particle Count | Particle Count Per Unit Area (Particle Count/Square Micrometer) | Volume Fraction (%) | Average Area (Micrometer)* | Equivalent Diameter (Micrometer) |
|---|---|---|---|---|---|---|
| 242 | 1 | 11 | 1.44E−04 | 0.043 | 3.005 | 1.956 |
| 242 | 2 | 42 | 5.48E−04 | 0.103 | 1.892 | 1.552 |
| 242 | 3 | 173 | 2.26E−03 | 0.273 | 1.214 | 1.243 |
| 242 | 4 | 564 | 7.36E−03 | 0.570 | 0.777 | 0.995 |
| 242 | 5 | 1216 | 1.59E−02 | 0.780 | 0.493 | 0.793 |
| 242 | 6 | 1944 | 2.54E−02 | 0.790 | 0.312 | 0.631 |
| 242 | 7 | 2613 | 3.41E−02 | 0.676 | 0.199 | 0.503 |
| 242 | 8 | 2912 | 3.80E−02 | 0.480 | 0.127 | 0.402 |
| 242 | 9 | 3004 | 3.92E−02 | 0.314 | 0.080 | 0.320 |
| 242 | 10 | 3184 | 4.16E−02 | 0.209 | 0.050 | 0.253 |

*Average area is equal to the sum of the measured areas of the particles in the bin divided by the number of particles in the bin.

TABLE 9

Photomicrograph Analysis of Sample 243

| Sample | Bin | Particle Count | Particle Count Per Unit Area (Particle Count/Square Micrometer) | Volume Fraction (%) | Average Area (Micrometer)* | Equivalent Diameter (Micrometer) |
|---|---|---|---|---|---|---|
| 243 | 1 | 2 | 2.61E−05 | 0.009 | 3.270 | 2.040 |
| 243 | 2 | 14 | 1.83E−04 | 0.035 | 1.897 | 1.554 |
| 243 | 3 | 88 | 1.15E−03 | 0.137 | 1.199 | 1.235 |
| 243 | 4 | 417 | 5.44E−03 | 0.414 | 0.762 | 0.985 |
| 243 | 5 | 1157 | 1.51E−02 | 0.737 | 0.490 | 0.790 |
| 243 | 6 | 1895 | 2.47E−02 | 0.775 | 0.314 | 0.633 |
| 243 | 7 | 2534 | 3.31E−02 | 0.658 | 0.200 | 0.504 |
| 243 | 8 | 2908 | 3.80E−02 | 0.480 | 0.127 | 0.402 |
| 243 | 9 | 3306 | 4.32E−02 | 0.345 | 0.080 | 0.320 |
| 243 | 10 | 3596 | 4.69E−02 | 0.234 | 0.050 | 0.252 |

*Average area is equal to the sum of the measured areas of the particles in the bin divided by the number of particles in the bin.

TABLE 10

Photomicrograph Analysis of Ingot Sample

| Sample | Bin | Particle Count | Particle Count Per Unit Area (Particle Count/Square Micrometer) | Volume Fraction (%) | Average Area (Micrometer)* | Equivalent Diameter (Micrometer) |
|---|---|---|---|---|---|---|
| Ingot | 1 | 1 | 1.31E−05 | 0.036 | 27.824 | 5.952 |
| Ingot | 2 | 2 | 2.61E−05 | 0.051 | 19.507 | 4.984 |
| Ingot | 3 | 4 | 5.22E−05 | 0.062 | 11.962 | 3.903 |
| Ingot | 4 | 26 | 3.39E−04 | 0.269 | 7.955 | 3.183 |
| Ingot | 5 | 55 | 7.18E−04 | 0.344 | 4.811 | 2.475 |
| Ingot | 6 | 121 | 1.58E−03 | 0.501 | 3.186 | 2.014 |
| Ingot | 7 | 169 | 2.21E−03 | 0.434 | 1.973 | 1.585 |
| Ingot | 8 | 190 | 2.48E−03 | 0.313 | 1.266 | 1.269 |
| Ingot | 9 | 180 | 2.35E−03 | 0.188 | 0.802 | 1.010 |
| Ingot | 10 | 160 | 2.09E−03 | 0.105 | 0.505 | 0.802 |
| Ingot | 11 | 122 | 1.59E−03 | 0.051 | 0.324 | 0.642 |
| Ingot | 12 | 122 | 1.59E−03 | 0.032 | 0.201 | 0.505 |
| Ingot | 13 | 149 | 1.95E−03 | 0.025 | 0.128 | 0.403 |
| Ingot | 14 | 225 | 2.94E−03 | 0.024 | 0.080 | 0.320 |
| Ingot | 15 | 462 | 6.03E−03 | 0.029 | 0.049 | 0.249 |

*Average area is equal to the sum of the measured areas of the particles in the bin divided by the number of particles in the bin.

A graphical representation of the data included in Tables 2-10 is shown in FIGS. 3 and 4. Specifically, FIG. 3 shows the particle count per unit area v. particle equivalent diameter and FIG. 4 shows volume fraction v. particle equivalent diameter for each of the samples 12, 13, 14, 16, 240, 241, 242, 243 and Ingot.

B. Example 2

The aluminum alloys of Example 2 include samples 240, 241, 242, 243, 265, 266, 267, 268, 269, 270, 271, and 2219-T87. Each sample was heated, cast, hot rolled, cold rolled, batch annealed, and cold rolled as detailed in Example 1. The samples were then heated to temperatures of 350° F., 400° F., and 450° F. for 100 hours ("100 hour exposure") at each temperature. Samples 240, 241, 242 and 243 were also heated to temperatures of 350° F., 400° F., and 450° F. for 500 hours ("500 hour exposure") at each temperature. All of the samples were also exposed to a room temperature of 75° F. The elongation, tensile yield strength and ultimate tensile strength of each sample was then determined at room temperature pursuant to ASTM E8. Moreover, the elevated temperature elongation, tensile yield strength and ultimate tensile strength of each of the samples heated for 500 hours was also determined at the heating temperature (i.e., 350° F., 400° F., or 450° F.) pursuant to ASTM E21.

The results of the testing of samples 240, 241, 242, 243, 265, 266, 267, 268, 269, 270, 271, and 2219-T87 are shown in the following tables. The tables also show a comparison of the tensile yield strengths of the samples 240, 241, 242, 243, 265, 266, 267, 268, 269, 270, and 271 and the tensile yield strength of reference sample 2219-T87.

TABLE 11

Results of Room Temperature Tensile Testing After 100 Hour Exposures (ASTM E8)

| Sample | Exposure Temperature (deg. F.) | Tensile Yield Strength (TYS), ksi | Ultimate Tensile Strength (UTS), ksi | Elongation % | TYS, ksi (2219-T87) | % Increase from 2219-T87 |
|---|---|---|---|---|---|---|
| 240 | 75 | 58.7 | 62.65 | 5.5 | 49.5 | 15.7 |
| 240 | 350 | 52.8 | 57.3 | 3.5 | 44.4 | 15.9 |
| 240 | 400 | 46.15 | 51.05 | 3.25 | 37.9 | 17.9 |
| 240 | 450 | 41.75 | 46.15 | 3.5 | 34.25 | 18.0 |
| 241 | 75 | 56.55 | 60.7 | 5 | 49.5 | 12.5 |
| 241 | 350 | 53.35 | 56.95 | 3.75 | 44.4 | 16.8 |
| 241 | 400 | 46.35 | 50.8 | 3.75 | 37.9 | 18.2 |
| 241 | 450 | 43.95 | 49.1 | 4.5 | 34.25 | 22.1 |
| 242 | 75 | 54.8 | 60.1 | 6.75 | 49.5 | 9.7 |
| 242 | 350 | 51.75 | 55.85 | 4.75 | 44.4 | 14.2 |
| 242 | 400 | 46.85 | 51.65 | 4.5 | 37.9 | 19.1 |
| 242 | 450 | 44.15 | 49.75 | 4.5 | 34.25 | 22.4 |
| 243 | 75 | 53.2 | 57.5 | 7 | 49.5 | 7.0 |
| 243 | 350 | 48.35 | 52.1 | 4.75 | 44.4 | 8.2 |
| 243 | 400 | 44.25 | 48.8 | 4.5 | 37.9 | 14.4 |
| 243 | 450 | 39.35 | 44.05 | 4.75 | 34.25 | 13.0 |
| 265 | 75 | 50.45 | 54.6 | 6.75 | 49.5 | 1.9 |
| 265 | 350 | 47.9 | 50.95 | 5 | 44.4 | 7.3 |
| 265 | 400 | 41.5 | 45.05 | 4.5 | 37.9 | 8.7 |
| 265 | 450 | 36.95 | 41.1 | 4.75 | 34.25 | 7.3 |
| 266 | 75 | 50.4 | 54.6 | 5.5 | 49.5 | 1.8 |
| 266 | 350 | 47.3 | 50.6 | 5 | 44.4 | 6.1 |
| 266 | 400 | 42.25 | 46.1 | 4.5 | 37.9 | 10.3 |
| 266 | 450 | 37.95 | 42.35 | 4.5 | 34.25 | 9.7 |

| Sample | Exposure Temp. (deg. F.) | TYS, ksi | UTS, ksi | Elongation % | TYS, ksi (2219-T87) | % Increase from 2219-T87 |
|---|---|---|---|---|---|---|
| 267 | 75 | 51.8 | 55.8 | 6 | 49.5 | 4.4 |
| 267 | 350 | 48.4 | 52.1 | 4.5 | 44.4 | 8.3 |
| 267 | 400 | 43.3 | 47.4 | 4 | 37.9 | 12.5 |
| 267 | 450 | 38.65 | 43 | 4.75 | 34.25 | 11.4 |
| 268 | 75 | 59.55 | 63.55 | 5 | 49.5 | 16.9 |
| 268 | 350 | 53.25 | 57.4 | 4 | 44.4 | 16.6 |
| 268 | 400 | 46.05 | 50.45 | 3.25 | 37.9 | 17.7 |
| 268 | 450 | 39.75 | 44.5 | 5.75 | 34.25 | 13.8 |
| 269 | 75 | 59.05 | 62.45 | 4.5 | 49.5 | 16.2 |
| 269 | 350 | 53.4 | 56.95 | 3.5 | 44.4 | 16.9 |
| 269 | 400 | 46.25 | 50.2 | 3.25 | 37.9 | 18.1 |
| 269 | 450 | 38.5 | 42.35 | 4.25 | 34.25 | 11.0 |
| 270 | 75 | 62.1 | 66 | 4.5 | 49.5 | 20.3 |
| 270 | 350 | 57.9 | 62 | 3 | 44.4 | 23.3 |
| 270 | 400 | 49.6 | 54.8 | 2.75 | 37.9 | 23.6 |
| 270 | 450 | 45 | 50.35 | 4 | 34.25 | 23.9 |
| 271 | 75 | 59.8 | 63.45 | 5 | 49.5 | 17.2 |
| 271 | 350 | 52.9 | 56.65 | 3 | 44.4 | 16.1 |
| 271 | 400 | 46.2 | 50.4 | 3.5 | 37.9 | 18.0 |
| 271 | 450 | 40 | 44.45 | 5.25 | 34.25 | 14.4 |
| 2219-T87 | 75 | 49.5 | 64.85 | 13.25 | N/A | N/A |
| 2219-T87 | 350 | 44.4 | 60.6 | 7.75 | N/A | N/A |
| 2219-T87 | 400 | 37.9 | 55.2 | 8.25 | N/A | N/A |
| 2219-T87 | 450 | 34.25 | 52.35 | 9.5 | N/A | N/A |

TABLE 12

Results of Room Temperature Testing After 500 Hour Exposures (ASTM E8)

| Sample | Exposure Temp. (deg. F.) | TYS, ksi | UTS, ksi | Elongation % |
|---|---|---|---|---|
| 240 | 75 | 58.7 | 62.65 | 5.5 |
| 240 | 350 | 49.2 | 54 | 3.25 |
| 240 | 400 | 43.15 | 48.1 | 4.25 |
| 240 | 450 | 39.05 | 44.4 | 6.25 |
| 241 | 75 | 56.55 | 60.7 | 5 |
| 241 | 350 | 49.9 | 54.15 | 3.5 |
| 241 | 400 | 44.45 | 49.55 | 4.5 |
| 241 | 450 | 41 | 46.75 | 5.25 |
| 242 | 75 | 54.8 | 60.1 | 6.75 |
| 242 | 350 | 48.7 | 53.1 | 4.5 |
| 242 | 400 | 45.05 | 50.25 | 4.25 |
| 242 | 450 | 41.65 | 48.4 | 5.5 |
| 243 | 75 | 53.2 | 57.5 | 7 |
| 243 | 350 | 46.5 | 50.35 | 4 |
| 243 | 400 | 40.95 | 45.6 | 4.75 |
| 243 | 450 | 36.8 | 41.8 | 5 |

TABLE 13

Results of Elevated Temperature Tensile Testing After 500 Hour Exposures (ASTM E21)

| Sample | Test Temperature (deg. F.) | TYS, ksi | UTS, ksi | Elongation % |
|---|---|---|---|---|
| 240 | 75* | 58.7 | 62.65 | 5.5 |
| 240 | 350 | 35.2 | 43.1 | 17.5 |
| 240 | 400 | 19.95 | 30.9 | 31 |
| 240 | 450 | 13.15 | 22.05 | 43 |
| 241 | 75* | 56.55 | 60.7 | 5 |
| 241 | 350 | 37.65 | 45.45 | 11 |
| 241 | 400 | 23.7 | 32.9 | 25.5 |
| 241 | 450 | 15 | 24.2 | 33 |
| 242 | 75* | 54.8 | 60.1 | 6.75 |
| 242 | 350 | 41.25 | 45.45 | 12 |
| 242 | 400 | 24.8 | 32.65 | 21.5 |
| 242 | 450 | 18.75 | 27.6 | 33 |
| 243 | 75* | 53.2 | 57.5 | 7 |
| 243 | 350 | 37.4 | 42.9 | 12 |
| 243 | 400 | 25.1 | 32.9 | 23 |
| 243 | 450 | 15.2 | 23.8 | 34.5 |

*The properties of the samples exposed to a room temperature of 75 degrees F. were measured using ASTM E8.

Figure 5:
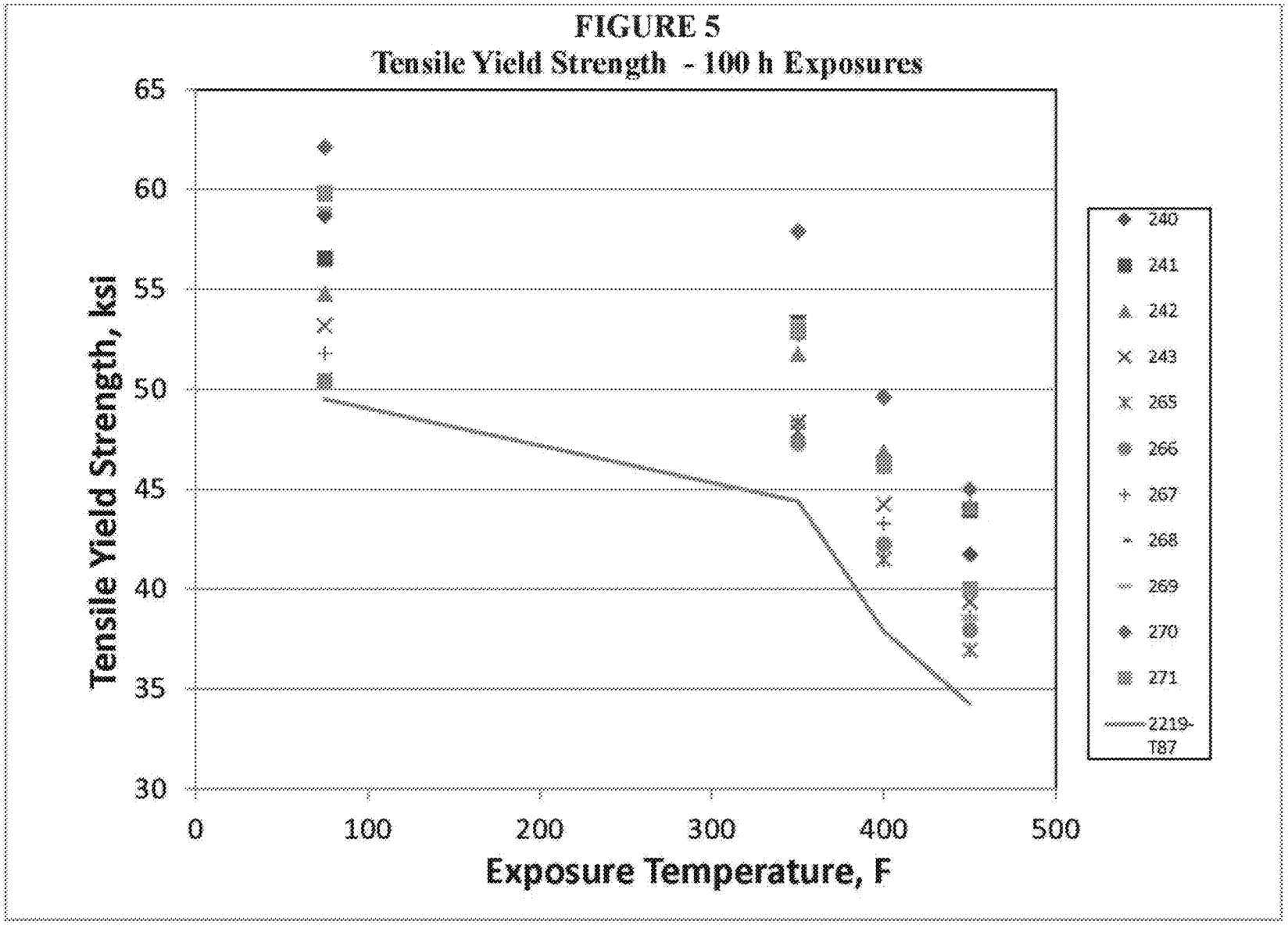
FIG. 5 illustrates the tensile yield strengths of some embodiments of the present invention after exposure at various temperatures for 100 hours.
Figure 6:
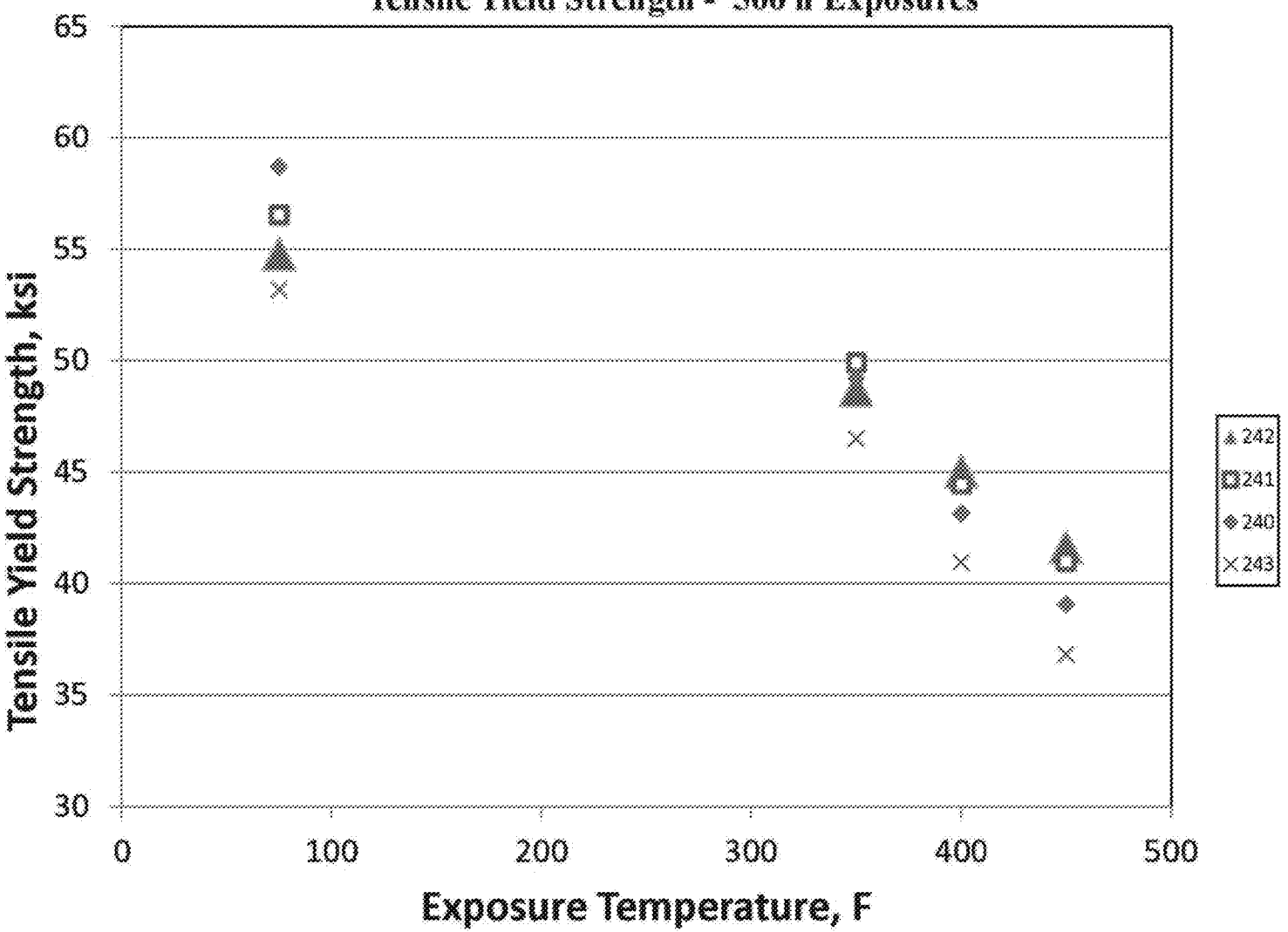
FIG. 6 illustrates the tensile yield strengths of some embodiments of the present invention after exposure at various temperatures for 500 hours.
Figure 7:
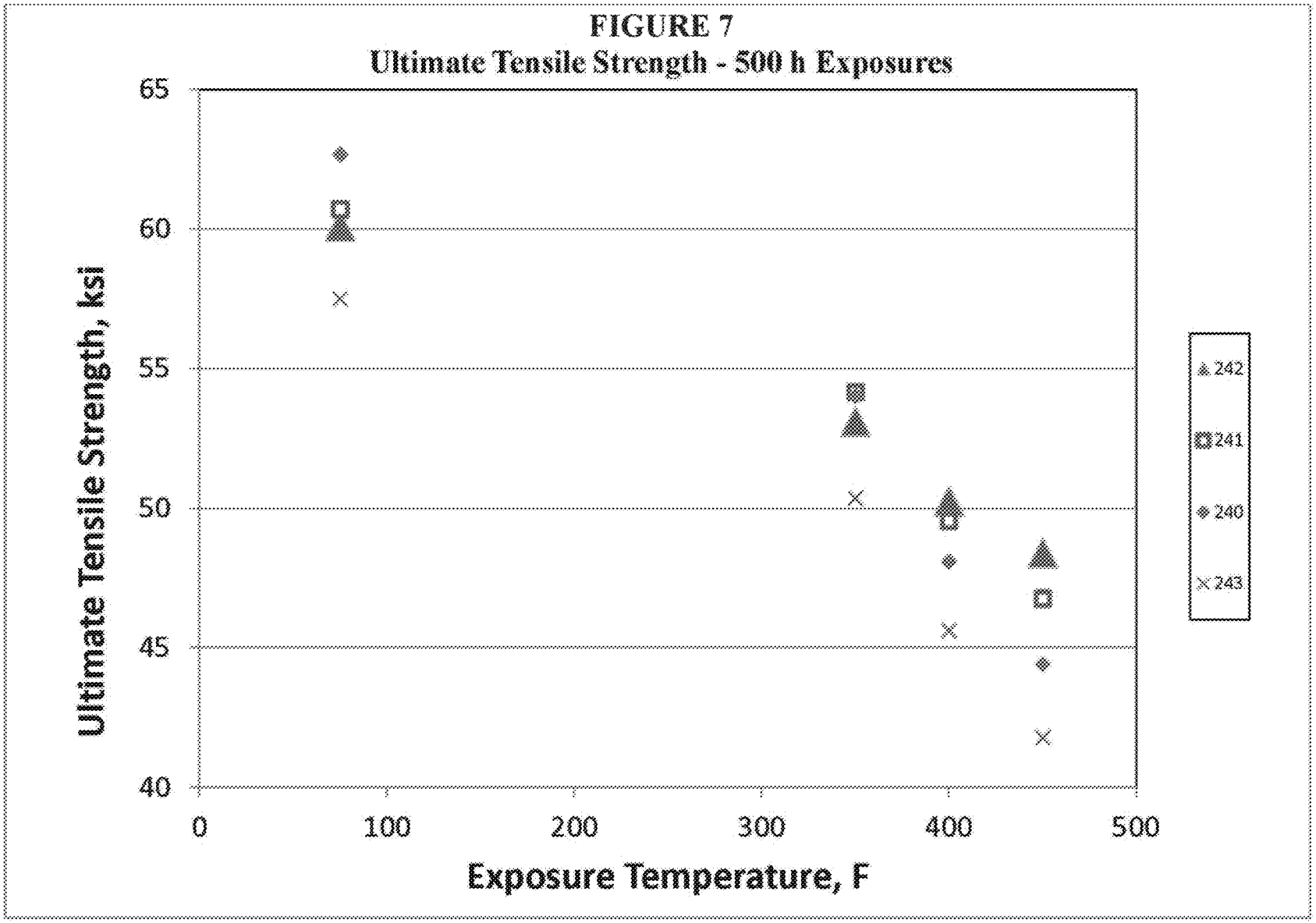
FIG. 7 illustrates the ultimate tensile strengths of some embodiments of the present invention after exposure at various temperatures for 500 hours.
Figure 8:
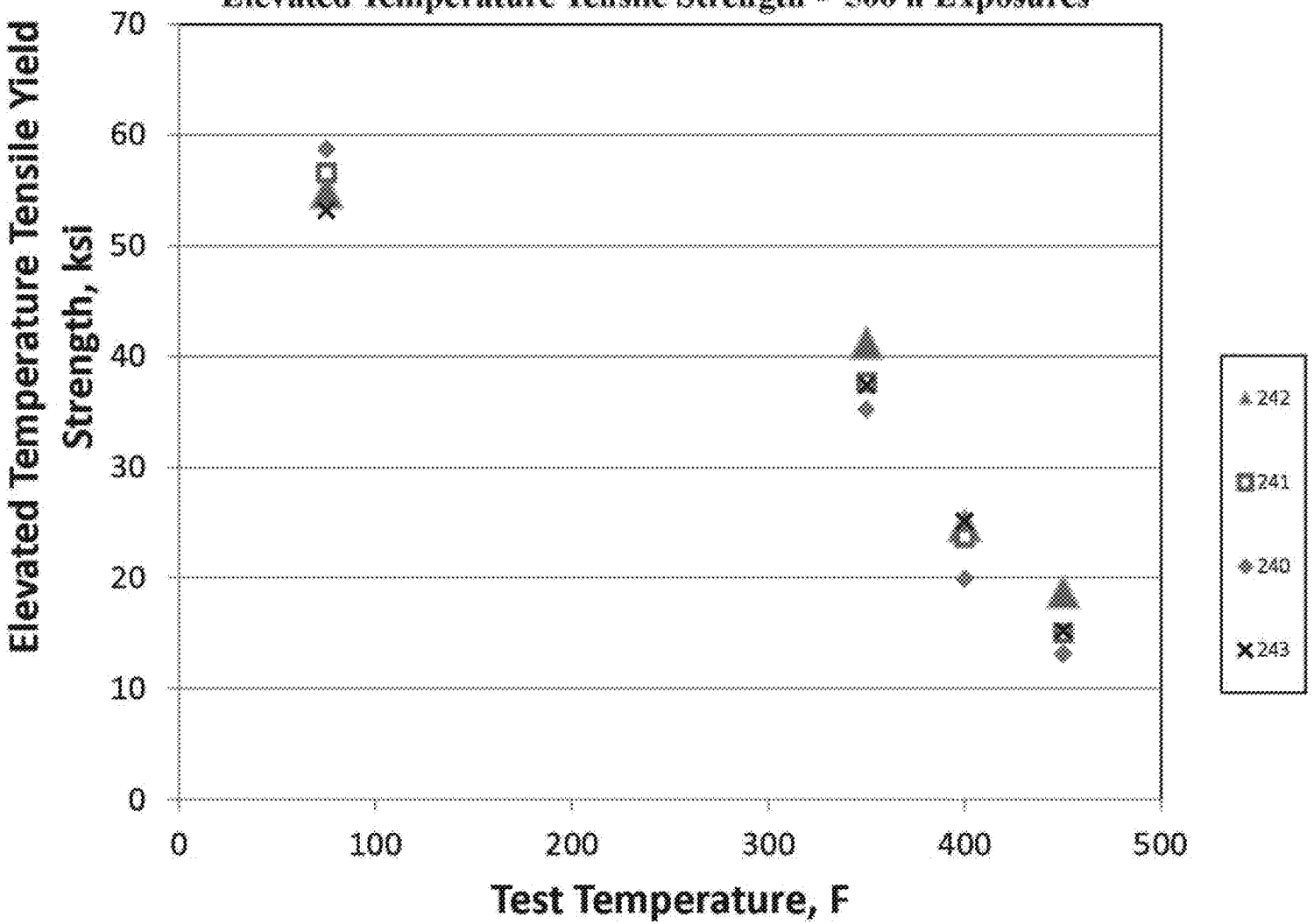
FIG. 8 illustrates the elevated temperature tensile strengths of some embodiments of the present invention after exposure at various temperatures for 500 hours.

A graphical representation of the data included in Tables 11, 12, and 13 is shown in FIG. 5-8. Specifically, FIG. 5 shows the tensile yield strength for samples 240, 241, 242, 243, 265, 266, 267, 268, 269, 270, 271, and 2219-T87 after 100 hour exposure at the various test temperatures. FIGS. 6 and 7 show the tensile strength and ultimate tensile strength, respectively, of samples 240, 241, 242, and 243 after 500 hour exposure at the various test temperatures. FIG. 8 shows the elevated temperature tensile strength of samples 240, 241, 242, and 243 after 500 hour exposure at the various test temperatures.

While a number of embodiments of the present invention have been described, it is understood that these embodiments are illustrative only, and not restrictive, and that many modifications may become apparent to those of ordinary skill in the art. Further still, the various steps may be carried out in any desired order (and any desired steps may be added and/or any desired steps may be eliminated).

What is claimed is:

1. A product comprising:

an aluminum alloy strip;

wherein the aluminum alloy strip includes:

(i) from 0.8 to 2.2 wt. % Mn; and (ii) from 0.6 to 2.0 wt. % Fe; and (iii) wherein the manganese and iron are contained within the aluminum alloy strip in an amount sufficient to achieve a hypereutectic composition;

wherein the aluminum alloy strip includes a maximum of 1.5 wt % silicon;

wherein a near surface of the aluminum alloy strip comprises particles, wherein at least 90% of the particles are small particles;

wherein each small particle has a particular equivalent diameter;

wherein the particular equivalent diameter is less than 3 micrometers;

wherein a quantity per unit area of the small particles having the particular equivalent diameter is at least 0.01 particles per square micrometer at the near surface of the aluminum alloy strip; and wherein a central portion of the aluminum alloy strip comprises a plurality of dendrites having a size of 20 microns to 50 microns.

2. The product of claim 1, wherein an oxygen content of the aluminum alloy strip is 0.1 weight percent or less.

3. The product of claim 2, wherein the oxygen content of the aluminum alloy strip is 0.01 weight percent or less.

4. The product of claim 1, wherein the particular equivalent diameter is at least 0.3 micrometers.

5. The product of claim 1, wherein the particular equivalent diameter ranges from 0.3 micrometers to 0.5 micrometers.

6. The product of claim 1, wherein the particular equivalent diameter is 0.5 micrometers and wherein the quantity per unit area of the small particles having the particular equivalent diameter is at least 0.03 particles per square micrometer at the near surface of the aluminum alloy strip.

7. The product of claim 1, wherein the product is selected from the group consisting of can body stock and can end stock.

8. The product of claim 1, wherein at least 98% of the particles of the near surface of the aluminum alloy strip are small particles.

9. The product of claim 1, wherein the particular equivalent diameter of the small particles is less than 1 micrometer, and wherein a volume fraction of the small particles having the particular equivalent diameter is at least 0.2 percent at the near surface of the aluminum alloy strip.

10. The product of claim 1, wherein the volume fraction of the small particles having the particular equivalent diameter is at least 0.65 percent, and wherein the particular equivalent diameter ranges from 0.5 micrometers to 0.85 micrometers.

11. The product of claim 1, wherein the aluminum alloy strip comprises up to 3.0 wt. % Mg, up to 1.0 wt. % Cu and up to 1.5 wt. % Zn.

* * * * *